US009770747B2

(12) United States Patent
Ishii et al.

(10) Patent No.: US 9,770,747 B2
(45) Date of Patent: Sep. 26, 2017

(54) ROLLING APPARATUS FOR FLAT-ROLLED METAL MATERIALS

(71) Applicant: NIPPON STEEL & SUMITOMO METAL CORPORATION, Tokyo (JP)

(72) Inventors: Atsushi Ishii, Tokyo (JP); Daisuke Kasai, Tokyo (JP); Shigeru Ogawa, Tokyo (JP); Hiroki Kato, Tokyo (JP); Yuuto Okabe, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 371 days.

(21) Appl. No.: 14/356,310

(22) PCT Filed: Jun. 25, 2013

(86) PCT No.: PCT/JP2013/067406
§ 371 (c)(1),
(2) Date: May 5, 2014

(87) PCT Pub. No.: WO2014/003014
PCT Pub. Date: Jan. 3, 2014

(65) Prior Publication Data

US 2014/0305179 A1 Oct. 16, 2014

(30) Foreign Application Priority Data

Jun. 26, 2012 (JP) ..... 2012-143465

(51) Int. Cl.
*B21B 38/06* (2006.01)
*B21B 38/08* (2006.01)
*B21B 31/02* (2006.01)

(52) U.S. Cl.
CPC ..... *B21B 38/06* (2013.01); *B21B 38/08* (2013.01); *B21B 31/02* (2013.01); *B21B 2265/12* (2013.01); *B21B 2273/04* (2013.01)

(58) Field of Classification Search
CPC ..... B21B 37/58; B21B 37/62; B21B 37/64; B21B 38/08; B21B 38/10; B21B 2265/12;
(Continued)

(56) References Cited

U.S. PATENT DOCUMENTS 5,806,360 A * 9/1998 Dumas ..... B21B 13/023 72/238
6,748,782 B1 * 6/2004 Nakajima ..... B21B 31/02 72/237
(Continued)

FOREIGN PATENT DOCUMENTS

DE 1527618 A1 * 1/1970 ..... B21B 31/02
DE 2757701 A1 * 7/1978 ..... B21B 38/06
(Continued)

OTHER PUBLICATIONS

International Search Report for PCT/JP2013/067406 dated Sep. 3, 2013.
(Continued)

*Primary Examiner* — James S McClellan
*Assistant Examiner* — Peter Iannuzzi
(74) *Attorney, Agent, or Firm* — Birch, Stewart, Kolasch & Birch, LLP

(57) ABSTRACT

[Object]
To provide a rolling apparatus capable of accurately detecting a rolling direction force applied to a work roll chock.
[Solution]
A rolling apparatus for flat-rolled metal materials includes a pair of upper and lower work rolls 1 and 2, and a pair of upper and lower backup rolls 3 and 4. The rolling apparatus includes a pair of work roll chocks 5 and 6 configured to hold the respective work rolls, housings 10 configured to hold the work roll chocks, and load detection devices 21 to 24 provided in the work roll chocks, the load detection
(Continued)

devices each detecting a load acting on one of the housings from one of the work roll chocks on an entry side in a rolling direction or on an exit side in the rolling direction. The load detection devices are each disposed so as to face one of the housings using a point of effort of a rolling direction force of one of the work rolls as a reference, such that a rotation moment generated on each of the work roll chocks caused by the rolling direction force is equal to a counter rotation moment generated by counterforce against the rotation moment.

13 Claims, 22 Drawing Sheets

(58) Field of Classification Search
CPC . B21B 2271/02; B21B 38/06; B21B 2273/04; B21B 31/02; B21B 38/00
USPC ..... 72/10.4, 21.4
See application file for complete search history.

(56) References Cited

U.S. PATENT DOCUMENTS

| | | | | |
|---|---|---|---|---|
| 7,310,982 | B2 | 12/2007 | Ogawa et al. | |
| 2006/0230799 | A1 | 10/2006 | Ogawa et al. | |
| 2012/0000543 | A1* | 1/2012 | Keintzel | F15B 21/008 137/12 |
| 2013/0000371 | A1* | 1/2013 | Kasai | B21B 38/105 72/10.4 |

FOREIGN PATENT DOCUMENTS

| | | | | |
|---|---|---|---|---|
| DE | 3811875 | A1 * | 4/1989 | B21B 31/02 |
| DE | 3807654 | A1 * | 9/1989 | B21B 31/02 |
| DE | CA 2575328 | A1 * | 12/2006 | B21B 31/02 |
| EP | 2 777 834 | A1 | 9/2014 | |
| GB | 1544754 | A * | 4/1979 | B21B 38/10 |
| JP | EP 0685273 | A1 * | 12/1995 | B21B 13/08 |
| JP | WO 0112353 | A1 * | 2/2001 | B21B 13/023 |
| JP | WO 0164360 | A1 * | 9/2001 | B21B 31/02 |
| JP | CA 2392114 | A1 * | 2/2003 | B21B 31/02 |
| JP | 2006-82118 | A | 3/2006 | |
| JP | 2006-110627 | A | 4/2006 | |
| JP | 2007-260775 | A | 10/2007 | |
| JP | 2009-208151 | A | 9/2009 | |
| JP | WO 2011129453 | A1 * | 10/2011 | B21B 37/58 |
| JP | 4819202 | B1 | 11/2011 | |
| JP | 2012-148339 | A | 8/2012 | |
| SU | 814498 | A1 * | 3/1981 | B21B 31/02 |
| WO | WO 2004/082860 | A1 | 9/2004 | |
| WO | WO 2010/016216 | A1 | 2/2010 | |
| WO | WO 2011/129453 | A1 | 10/2011 | |

OTHER PUBLICATIONS

Written Opinion of the International Searching Authority for PCT/JP2013/067406 dated Sep. 3, 2013.
Korean Office Action for Korean Application No. 10-2014-7024785, dated Feb. 18, 2016, with an English translation.
Extended European Search Report, dated Aug. 7, 2015, for European Application No. 13810136.5.

* cited by examiner

ROLLING APPARATUS FOR FLAT-ROLLED METAL MATERIALS

TECHNICAL FIELD

The present invention relates to a rolling apparatus for flat-rolled metal materials.

BACKGROUND ART

In a rolling process of a flat-rolled metal material, it is very important to roll a sheet material in a form free from camber, or in a form not having bend in the left-right direction, in order to avoid not only a plane shape defect and a dimensional accuracy defect of the rolled material but also to avoid sheet pass troubles such as a zigzag movement and a tail crash.

Further, a warp that occurs at the time of rolling a sheet material also has a large influence on productivity of products, such as reduction in rolling efficiency and increase in the number of refining processes. For example, as for the refining processes, there are cases where it is necessary to correct camber or a warp using a leveler or by performing pressing or the like, and in an extreme case, a defect part may have to be cut. Still further, in the case where camber or a warp occurred to a large extent, the rolling facility may be damaged due to the collision of the sheet. In this case, it is not only that the sheet itself loses the product value, but that it brings about tremendous damages such as production interruption and repairing of the rolling facility.

In addition, in order to control the above camber with high accuracy, it is also important to perform an initial setting called zero point adjustment. The zero point adjustment is performed as follows: kiss-roll tightening is conducted by operating a screw down device in a roll-rotating state; and, a point in which a measurement value of a rolling load corresponding to a preset zero point adjustment load (preset to rated load of 15% to 85%) is set as a zero point of a reduction position, and the reduction position is set as a starting point (reference) in reduction control. In this case, the difference between left and right reduction positions, that is, the zero point of reduction leveling is often adjusted simultaneously. Also, as for the zero point adjustment of the reduction leveling, the measurement values of the rolling load on the time of kiss-roll tightening on the operator side and the driving side are adjusted such that the measurement values correspond to the preset zero point adjustment load. Note that the kiss-roll tightening means that, under the state that a rolled material is not present, the upper and lower work rolls are brought into contact with each other and a load is applied between the rolls.

Incidentally, to simplify expressions, the operator side and the driving side of the rolling mill, as the right and left sides when the rolling mill is seen from the front of the rolling direction, will be referred to as "right and left", respectively.

In view of the problems attributed to such camber, Patent Document 1 suggests a rolling method and a rolling apparatus capable of stably producing a flat-rolled metal material free from camber or having an extremely light camber. Specifically, in the rolling method and the rolling apparatus described in Patent Document 1, a load detection device measures a rolling direction force acting on roll chocks on an operator side and a driving side of a work roll, and a calculation device calculates a difference of the rolling direction forces between the operator side and the driving side. Then, a control device controls a left-right swivelling component of a roll gap of a rolling mill such that the difference becomes zero.

In view of the problem of a warp, Patent Document 2 suggests a rolling method and a rolling apparatus capable of stably producing a flat-rolled metal material having an extremely light warp. Specifically, in the rolling method and the rolling apparatus described in Patent Document 2, load detection devices provided on both entry side and exit side of upper and lower roll chocks of work rolls measure rolling direction forces acting on the upper and lower work roll chocks. Then, a calculation device calculates a difference between the rolling direction force on the upper side and the rolling direction force on the lower side, that is, an upper and lower rolling direction force difference. After that, upper and lower asymmetric components of the rolling apparatus is controlled such that the upper and lower rolling direction force difference is decreased.

In view of the problem of zero point adjustment, in Patent Document 3, it is discovered that a rolling direction force occurs even with zero point adjustment by the kiss roll state, pointed out that the rolling direction force does not affect a roll thrust force, and accordingly, there is proposed a method enabling more precise initial reduction position adjustment (reduction zero point adjustment) of a rolling mill.

Further, in order to produce a flat-rolled metal material free from camber, in a rolling method and a rolling apparatus described in Patent Document 4, rolling direction forces acting on roll chocks on an operator side and a driving side of a work roll are measured, a difference of the rolling direction forces between the operator side and the driving side is calculated, a left-right swivelling component of a roll gap of the rolling mill is controlled by using control gain such that the difference become a control target value, and the control gain is changed depending on a condition during rolling.

Still further, Patent Document 5 suggests a rolling mill and a rolling method capable of producing a flat-rolled metal material free from camber or warp, achieving zero point adjustment with high accuracy, and easily achieving application of a strong roll bending force. In the rolling mill and the rolling method described in Patent Document 5, a work roll chock is pressed against a contact surface with a housing window or a project block of the rolling mill in a rolling direction. Then, a load detection device measures rolling direction forces acting on roll chocks on an operator side and a driving side of a work roll, and a calculation device a calculation device calculates a difference of the rolling direction forces between the operator side and the driving side. A control device calculates left-right swivelling component control quantity of a roll gap of the rolling mill such that the difference become a control target value, and controls the roll gap on the basis of the calculated value of the left-right swivelling component control quantity of the roll gap.

Here, in any of the rolling methods and the rolling apparatuses described in the above Patent Documents 1 to 5, the rolling direction forces are measured. Accordingly, with reference to FIG. 1, the measurement of the rolling direction forces according to Patent Documents 1 to 5 will be described specifically. FIG. 1 is a view schematically showing a rolling apparatus.

The rolling apparatus shown in FIG. 1 includes an upper work roll 1 supported by an upper work roll chock 5, an upper backup roll 3 supported by an upper backup roll chock 7, a lower work roll 2 supported by a lower work roll chock 6, and a lower backup roll 4 supported by a lower backup roll chock 8. The upper backup roll 3 is disposed on the upper side of the upper work roll 1 in contact with the upper work roll 1. In the same manner, the lower backup roll 4 is disposed on the lower side of the lower work roll 2 in contact with the lower work roll 2. Further, the rolling apparatus shown in FIG. 1 includes a screw down device 9 that applies a rolling load to the upper work roll 1. A flat-rolled metal material M to be rolled by the rolling apparatus moves in a rolling direction F between the upper work roll 1 and the lower work roll 2.

Though FIG. 1 basically shows only the apparatus construction on the operator side, similar devices exist on the driving side, too.

The rolling direction force acting on the upper work roll 1 of the rolling apparatus is basically supported by the upper work roll chock 5. Between the upper work roll chock 5 and a housing or a project block, there are provided an upper work roll chock exit side load detection device 121 on an exit side of the upper work roll chock 5 in the rolling direction, and an upper work roll chock entry side load detection device 122 on an entry side of the upper work roll chock 5 in the rolling direction. The upper work roll chock exit side load detection device 121 can detect the force acting between the member such as the housing or the project block and the upper work roll chock 5 on the exit side of the upper work roll chock 5 in the rolling direction. The upper work roll chock entry side load detection device 122 can detect the force acting between the member such as the project block and the upper work roll chock 5 on the entry side of the upper work roll chock 5 in the rolling direction. To simplify the device construction, those load detection devices 121 and 122 preferably and ordinarily have a construction for measuring a compressive force.

The upper work roll chock exit side load detection device 121 and the upper work roll chock entry side load detection device 122 are connected to an upper work roll rolling direction force calculation device 141. The upper work roll rolling direction force calculation device 141 calculates a difference between a load detected by the upper work roll chock exit side load detection device 121 and a load detected by the upper work roll chock entry side load detection device 122, and, on the basis of the calculation result, calculates the rolling direction force acting on the upper work roll chock 5.

In the same manner, as for the lower work roll 2, between the lower work roll chock 6 and the housing or the project block, there are provided an lower work roll chock exit side load detection device 123 on an exit side of the lower work roll chock 6 in the rolling direction, and a lower work roll chock entry side load detection device 124 on an entry side of the lower work roll chock 6 in the rolling direction. The lower work roll chock exit side load detection device 123 and the lower work roll chock entry side load detection device 124 are connected to a lower work roll rolling direction force calculation device 142. The lower work roll rolling direction force calculation device 142 calculates, on the basis of measurement values obtained by those load detection devices 123 and 124, the rolling direction force acting on the lower work roll chock 6 in the same manner as in the upper work roll 1.

PRIOR ART DOCUMENT(S)

Patent Document(s)

[Patent Document 1] WO2004/082860
[Patent Document 2] JP 2007-260775A
[Patent Document 3] WO2011/129453
[Patent Document 4] JP 2006-82118A
[Patent Document 5] JP 2012-148339A

SUMMARY OF THE INVENTION

Problem(s) to be Solved by the Invention

Here, taking into consideration the drawings on the figures in Patent Documents 1 to 5 and technical common knowledge in the field of rolling, a load detection device is normally a load cell. Considering that work roll chocks are moved and changed during working, the load cell is generally attached to a member that faces the work roll chock in a rolling direction, such as a project block or a housing.

FIG. 2 is an enlarged side view of the work roll chocks of the rolling apparatus shown in FIG. 1 and a periphery thereof, and shows an example in which load detection devices are attached to project blocks. In the example shown in FIG. 2, a housing 10 is provided with an exit side project block 11 and an entry side project block 12. The exit side project block 11 and the entry side project block 12 are formed so as to protrude from the housing 10 towards the inner side of the rolling apparatus.

In the example shown in FIG. 2, the upper work roll chock exit side load detection device 121 and the lower work roll chock exit side load detection device 123 are provided on the exit side project block 11. On the other hand, the upper work roll chock entry side load detection device 122 and the lower work roll chock entry side load detection device 124 are provided on the entry side project block 12. Note that, although a protection cover or waterproofing for preventing water or the like entering inside the device is generally provided on the surface of the load detection device, they are not shown in the figure.

FIG. 2 also shows an example of a kiss-roll tightening state. As shown in FIG. 2, each of the load detection devices 121, 122, 123, and 124 has a small size in an opening/closing direction, that is, a draft direction (also referred to as height direction) of the rolls. Accordingly, the distances that the load detection devices 121 and 122 are in contact with side surfaces of the work roll chock 5 and the distances that the load detection devices 123 and 124 are in contact with side surfaces of the work roll chock 6 are small.

Here, in the example shown in FIG. 2, the positions (heights) of the respective load detection devices 121 and 122 in the draft direction are the same as the position (height) of a roll axis A1 of the work roll 1 held by the work roll chock 5 in the draft direction, and the positions (heights) of the respective load detection devices 123 and 124 in the draft direction are the same as the position (height) of a roll axis A2 of the work roll 2 held by the work roll chock 6 in the draft direction. In this case, rolling direction forces applied to the work roll chocks 5 and 6 are appropriately detected by the load detection devices 121, 122, 123, and 124.

However, as shown in FIG. 3, for example, when the upper work roll 1 moves upward in the draft direction and a gap between the work rolls 1 and 2 increases, the height of the position of the roll axis A1 of the upper work roll 1 in the draft direction is larger than the heights of the positions of the upper work roll chock exit side load detection device 121 and the upper work roll chock entry side load detection device 122 in the draft direction. Accordingly, when the rolling direction force is applied to the upper work roll chock 5 from the upper work roll 1, the moment acts on the upper work roll chock 5, and thus, the upper work roll chock 5 rotates in a direction indicated by the arrow shown in FIG. 3. As a result, the upper work roll chock 5 tilts, and parts on the side surfaces of the upper work roll chock 5 come into contact with the project blocks 11, 12, and the like.

In this way, when parts on the side surfaces of the upper work roll chock 5 come into contact with the project blocks 11, 12, and the like, some of the rolling direction force applied to the upper work roll chock 5 from the upper work roll 1 is applied to the parts at which the upper work roll chock 5 comes into contact with the project blocks 11 and 12. Accordingly, it may not be possible for the load detection devices 121 and 122 to accurately detect the rolling direction force.

Further, for example, as shown in FIG. 4, when the work rolls 1 and 2 and the backup rolls 3 and 4 are worn away, and thus decrease in the roll diameters, the upper work roll chock 5 and the lower work roll chock 6 move downward in the draft direction. When the upper work roll chock 5 and the lower work roll chock 6 move downward, the height of the position of the axis A1 of the work roll 1 in the draft direction is smaller than the heights of the positions of the work roll chock exit side load detection device 121 and the work roll chock entry side load detection device 122, and the height of the position of the axis A2 of the work roll 2 in the draft direction is smaller than the heights of the positions of the work roll chock exit side load detection device 123 and the work roll chock entry side load detection device 124. Also in this case, in the same manner as the case shown in FIG. 3, the work roll chocks 5 and 6 tilt, and parts on the side surfaces of the work roll chocks 5 and 6 come into contact with the project blocks 11 and 12. As a result, it may not possible for the load detection devices 121, 122, 123, and 124 to accurately detect the rolling direction force.

Further, FIG. 5 is a cross-sectional plan view taken along the line VI-VI of FIG. 2, showing the work roll chocks and a periphery thereof. As can be seen from FIG. 5, the load detection devices 121 and 122 have sizes whose widths in the roll axis direction are small. Accordingly, the load detection devices 121 and 122 come into contact only with parts on the side surfaces of the work roll chocks 5 and 6 also in the roll axis direction.

That is, for example, as shown in FIG. 5, when the lower work roll 2 moves owing to roll shifting for a shift quantity D in the roll axis direction, it means that the center of a bearing (hereinafter, also referred to as "radial bearing") 5*a* to which force in a radial direction of the upper work roll chock 5 is applied shifts in the roll axis direction with respect to the positions of the load detection devices 121 and 122. Note that, in FIG. 5, a line C shows a line of the center of the radial bearing 5*a* of the upper work roll chock 5. Accordingly, the moment acts on the upper work roll chock 5, and thus, the upper work roll chock 5 rotates in a direction indicated by an arrow shown in FIG. 5. As a result, the upper work roll chock 5 tilts, and parts on the side surfaces of the upper work roll chock 5 come into contact with the project blocks 11 and 12.

In this way, when parts on the side surfaces of the upper work roll chock 5 come into contact with the project blocks 11, 12, and the like, some of the rolling direction force applied to the upper work roll chock 5 from the upper work roll 1 is applied to the parts at which the upper work roll chock 5 comes into contact with the project blocks 11 and 12. Accordingly, it may not be possible for the load detection devices 121 and 122 to accurately detect the rolling direction force.

The present invention has been made in view of the circumstances described above, and an object of the present invention is to provide a rolling apparatus capable of accurately detecting a rolling direction force applied to a work roll chock.

Means for Solving the Problem(s)

The inventors of the present invention have conducted studies on rolling apparatuses having various structures, with regard to detection of the rolling direction force applied to the work roll chock.

As a result, the inventors have found that in the case where a load detection device, that is, a load cell, is provided not on a housing but on a work roll chock, the work roll chock is less likely to tilt. Note that a load detection device according to the present invention mainly represents a load cell, and may also be a device of a strain gauge, a magnetostriction type, a capacitance type, a gyro type, a hydraulic type, a piezoelectric type, or the like.

The present invention has been achieved on the basis of the above findings, and the summary is as follows.

(1)

A rolling apparatus for a flat-rolled metal material, the rolling apparatus having at least a pair of upper and lower work rolls and a pair of upper and lower backup rolls, the rolling apparatus including:

a pair of work roll chocks configured to hold the respective work rolls;

housings or project blocks configured to hold the work roll chocks; and one or more load detection devices provided in one of the work roll chocks, the load detection devices each detecting a load acting on one of the work roll chocks on at least one of an entry side in a rolling direction and an exit side in the rolling direction, wherein the load detection devices are each disposed so as to face one of the housings or one of the project blocks using a point of effort of a rolling direction force of one of the work rolls as a reference, such that a rotation moment generated on each of the work roll chocks caused by the rolling direction force is equal to a counter rotation moment generated by counterforce against the rotation moment.

(2)

The rolling apparatus according to (1), wherein the load detection devices are disposed in a manner that heights of the load detection devices in a draft direction are identical to a height of a roll axis of a corresponding one of the work rolls in the draft direction, the roll axis being the point of effort of the rolling direction force of the work roll, or that the load detection devices are located within a range in which the load detection devices are each in contact with one of the housings or one of the project blocks.

(3)

The rolling apparatus according to (1), wherein the load detection devices are disposed in a manner that, on all occasions, a line extending in the rolling direction and including a roll axis of one of the work rolls is interposed between at least two of the load detection devices in a draft direction of the work roll, the roll axis being the point of effort of the rolling direction force of the work roll, and that the load detection devices each face one of the housings or one of the project blocks.

(4)

The rolling apparatus according to (3), wherein at least one of a plurality of the load detection devices is disposed at a position higher than a position of a roll axis of one of the work rolls held by a corresponding one of the work roll chocks, the load detection devices being arranged in a manner that the load detection devices are shifted from each other in the draft direction of the work roll, and wherein at least one of the plurality of the load detection devices is disposed at a position lower than the position of the roll axis of the one of the work rolls held by the corresponding one of the work roll chocks, the load detection devices being arranged in a manner that the load detection devices are shifted from each other in the draft direction of the work roll.

(5)

The rolling apparatus according to any one of (1) to (4), further including: a load calculation device configured to calculate a rolling direction force by adding up loads detected by a plurality of the load detection devices provided on the entry side in the rolling direction or the exit side in the rolling direction.

(6)

The rolling apparatus according to any one of (1) to (4), wherein the load detection devices are disposed in a manner that the load detection devices each protrude from a side surface of a corresponding one of the work roll chocks facing one of the housings or one of the project blocks, and wherein, on the side surface of the work roll chock from which each of the load detection devices protrude, a protruding part is provided at a position shifted from the load detection device in the draft direction of the work roll.

(7)

The rolling apparatus according to (6), wherein a load detection device disposed on the entry side in the rolling direction and a load detection device disposed on the exit side in the rolling direction are located at an identical height with each other in the draft direction of the work roll, and wherein a protruding part disposed on the entry side in the rolling direction and a protruding part disposed on the exit side in the rolling direction, the protruding parts being disposed in a corresponding manner to the respective load detection devices, are located at an identical height with each other in the draft direction of the work roll.

(8)

The rolling apparatus according to (6) or (7), further including:

a load calculation device configured to calculate a rolling direction force on a basis of a load detected by each of the load detection devices, an interval in the draft direction between an axis of a corresponding one of the work rolls held by a corresponding one of the work roll chocks and the load detection device, and an interval in the draft direction between the axis of the work roll and a corresponding one of the protruding parts.

(9)

The rolling apparatus according to any one of (1) to (8), wherein the load detection devices are disposed in a manner that positions of the load detection devices in a roll axis direction are identical to a center of a radial bearing provided to one of the work roll chocks, the center being the point of effort of the rolling direction force of a corresponding one of the work rolls, or that the load detection devices are located within a range in which the load detection devices are each in contact with one of the housings or one of the project blocks.

(10)

The rolling apparatus according to any one of (1) to (8), wherein the load detection devices are disposed in a manner that, on all occasions, a center of a radial bearing provided to one of the work roll chocks is interposed between at least two of the load detection devices in the roll axis direction of the work roll, and that the load detection devices each face one of the housings or one of the project blocks.

(11)

The rolling apparatus according to any one of (1) to (10), wherein the load detection devices are disposed in a manner that the load detection devices each protrude from a side surface of a corresponding one of the work roll chocks facing one of the housings or one of the project blocks, and wherein, on the side surface of the work roll chock from which each of the load detection devices protrude, a protruding part is provided at a position shifted from the load detection device in the roll axis direction.

(12)

The rolling apparatus according to (11), wherein a load detection device disposed on the entry side in the rolling direction and a load detection device disposed on the exit side in the rolling direction are located at an identical position with each other in the roll axis direction, and wherein a protruding part disposed on the entry side in the rolling direction and a protruding part disposed on the exit side in the rolling direction, the protruding parts being disposed in a corresponding manner to the respective load detection devices, are located at an identical position with each other in the roll axis direction.

(13)

The rolling apparatus according to (11) or (12), further including:

a load calculation device configured to calculate a rolling direction force on a basis of a load detected by each of the load detection devices, an interval in the roll axis direction between a center of a radial bearing provided to a corresponding one of the work roll chocks and the load detection device, and an interval in the roll axis direction between the center of the radial bearing and a corresponding one of the protruding parts.

(14)

The rolling apparatus according to (1), wherein at least three load detection devices are provided in one of the work roll chocks, and, in order that a point of effort of the rolling direction force of a corresponding one of the work rolls is included within an area defined by connecting the load detection devices, the load detection devices are disposed in a manner that the load detection devices shift in at least one of the draft direction and the roll axis direction of the work roll.

(15)

The rolling apparatus according to any one of (1) to (14), wherein the load detection devices each transmit a detection signal via radio to a load calculation device.

(16)

The rolling apparatus according to any one of (1) to (15), further including:

a cover configured to cover the load detection devices, the cover being provided between one of the housings or one of the project blocks and the load detection devices, wherein the cover is provided in a manner that the point of effort of the rolling direction force is located within a range in which one of the housings or one of the project blocks faces the cover.

Effect(s) of the Invention

According to the present invention, there is provided a rolling apparatus capable of accurately detecting a rolling direction force applied to a work roll chock.

BRIEF DESCRIPTION OF THE DRAWING(S)

Figure 1:
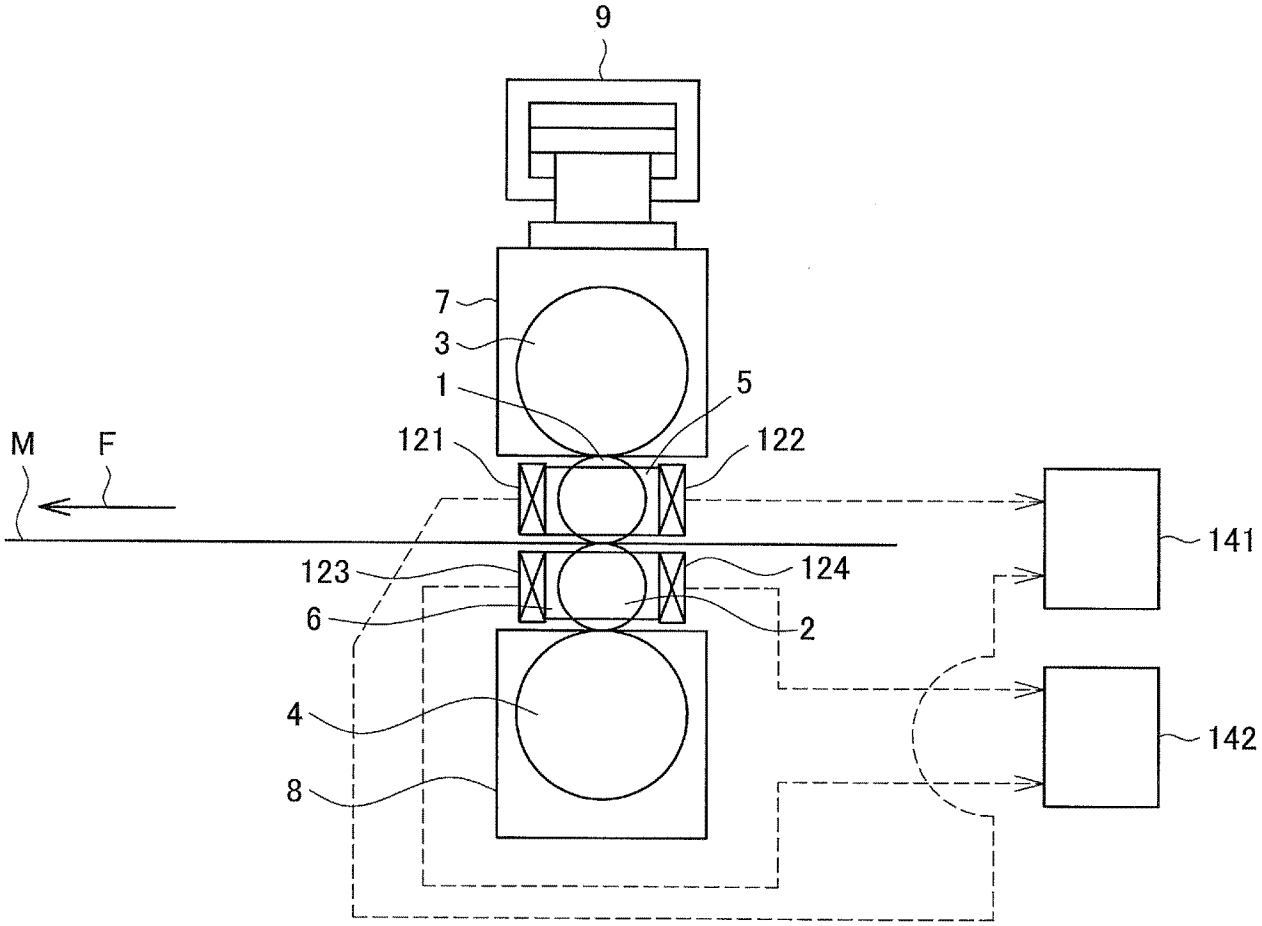
FIG. 1 is a view schematically showing a rolling apparatus having load detection devices of prior art.
Figure 2:
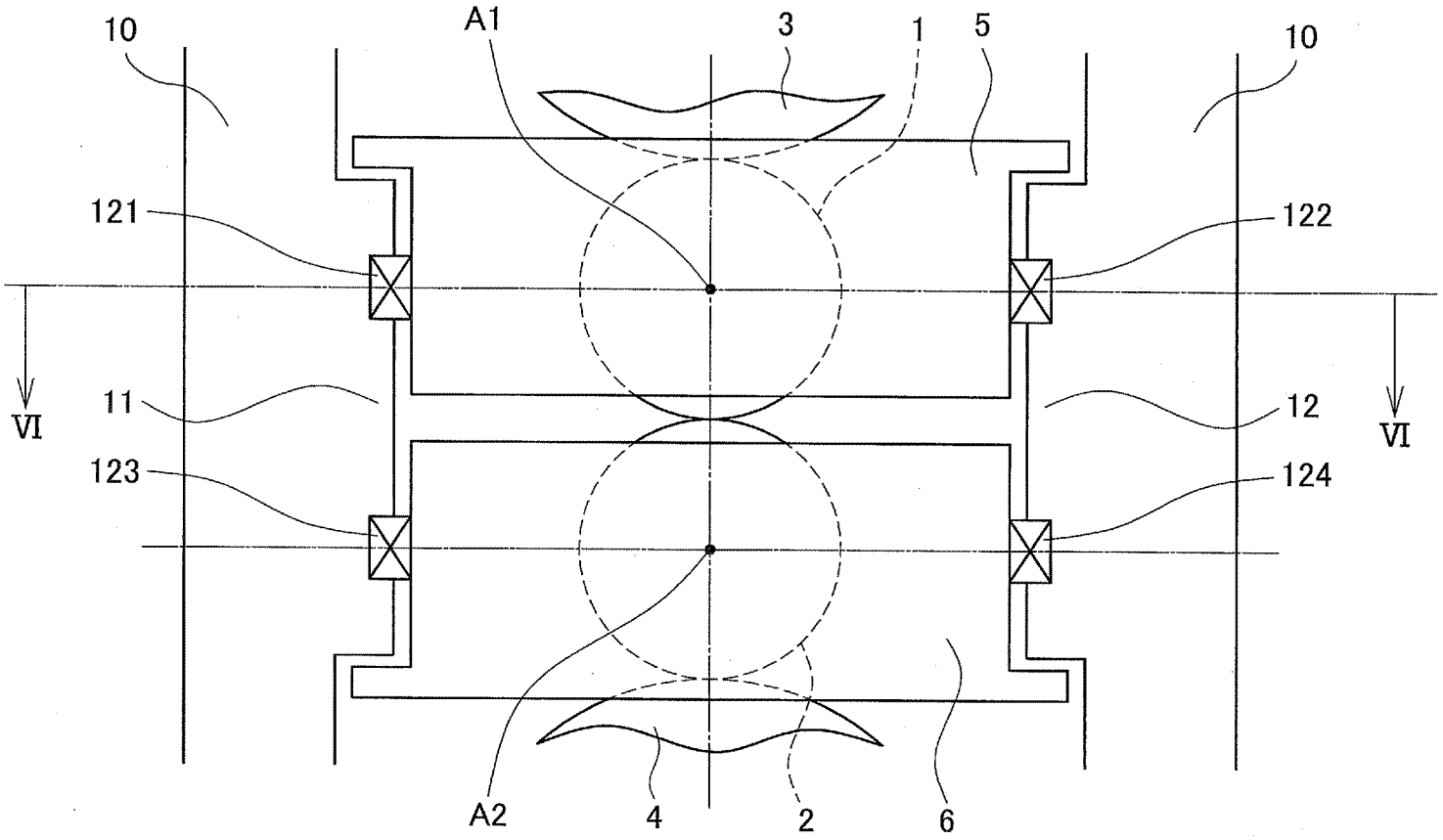
FIG. 2 is a side view schematically showing work roll chocks having load detection devices of prior art and a periphery thereof.
Figure 3:
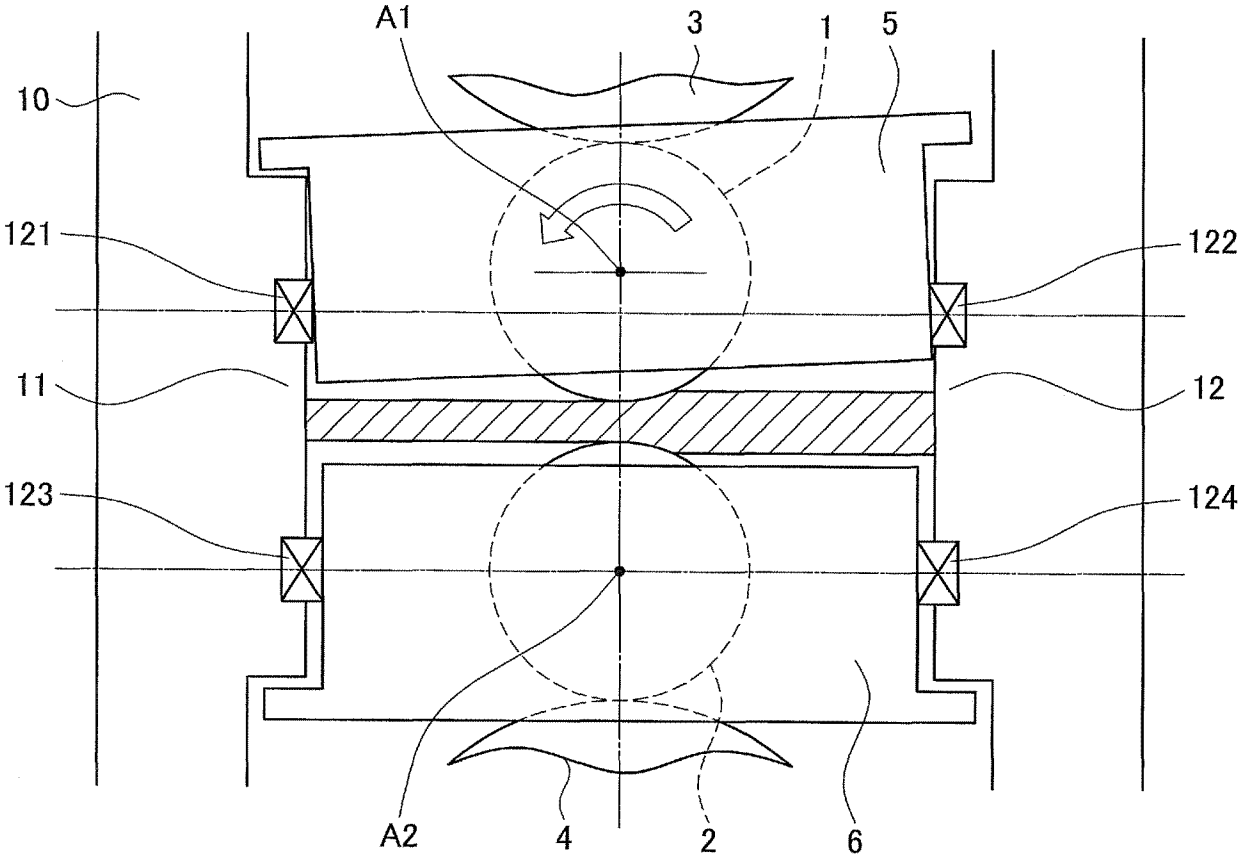
FIG. 3 is a side view illustrating a problem to be solved in measuring rolling direction forces by rolling load detection devices of prior art, and shows a state in which a roll axis of an upper work roll shifts with respect to positions of the rolling load detection devices in a draft direction and in which an upper work roll chock tilts.
Figure 4:
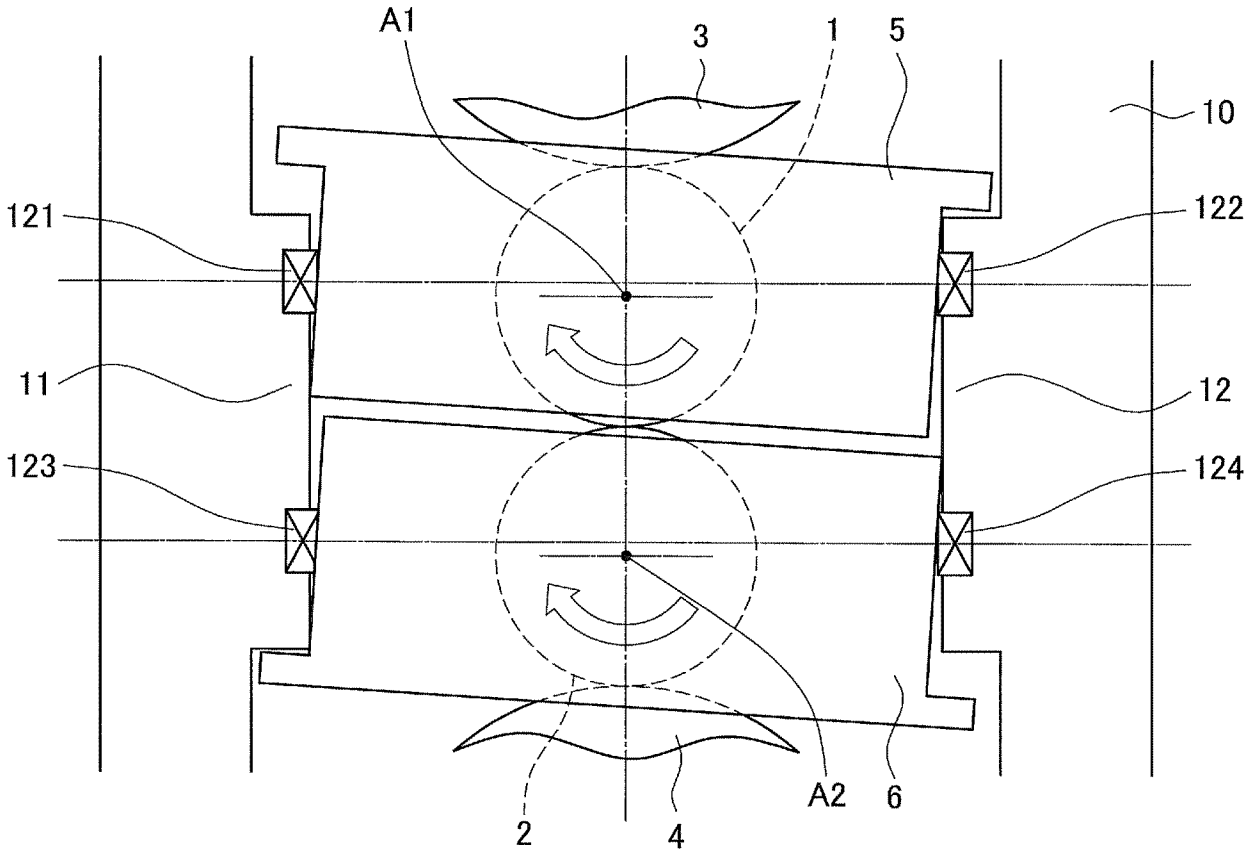

FIG. 4 is a side view illustrating a problem to be solved in measuring rolling direction forces by rolling load detection devices of prior art, and shows a state in which a roll axis of an upper work roll and a roll axis of a lower work roll shift with respect to positions of the rolling load detection devices in a draft direction and in which an upper work roll chock and a lower work roll chock tilt.

Figure 5:
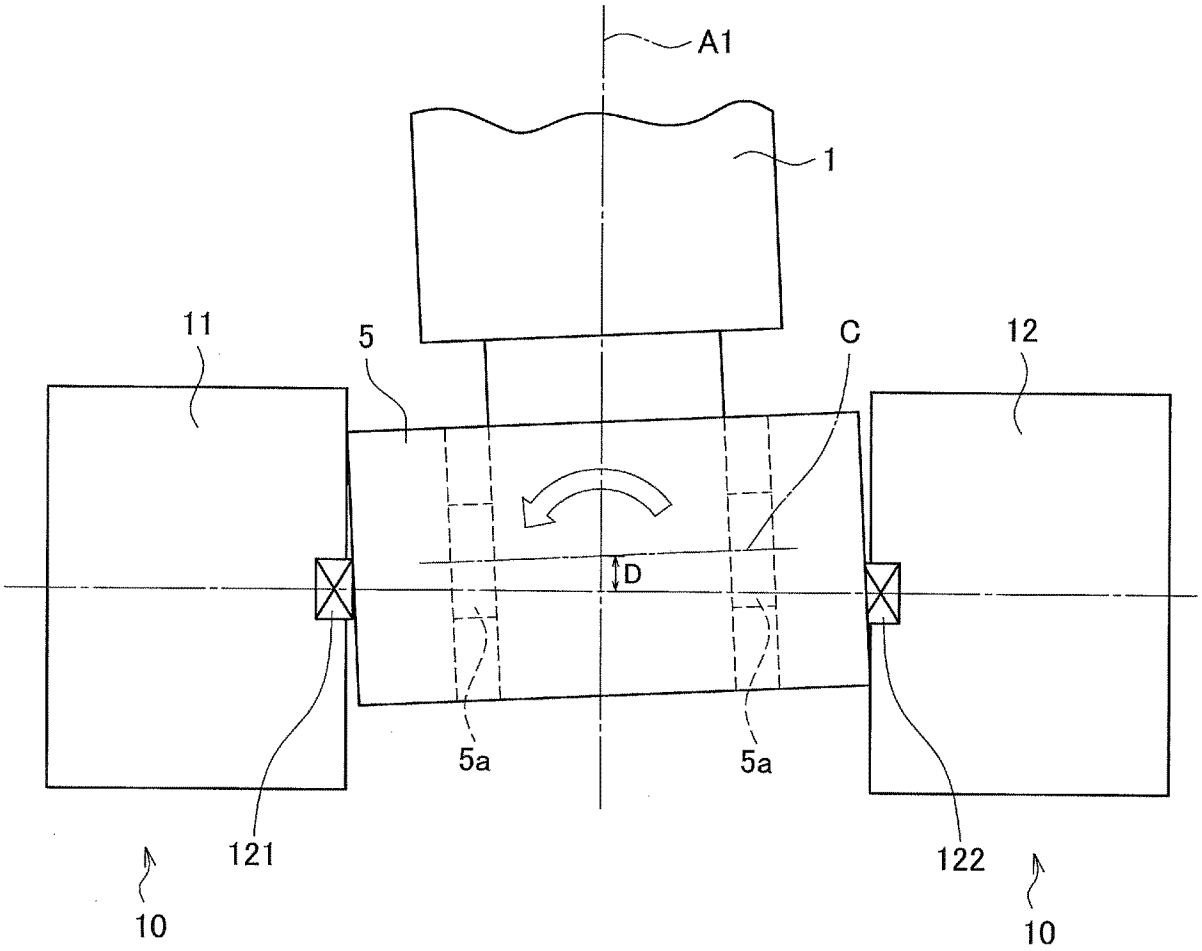

FIG. 5 is a cross-sectional plan view illustrating a problem to be solved in measuring a rolling direction force by rolling load detection devices of prior art, and shows a state in which a center of a radial bearing shifts with respect to positions of the rolling load detection devices in a roll axis direction and in which a work roll chock tilts.

Figure 6:
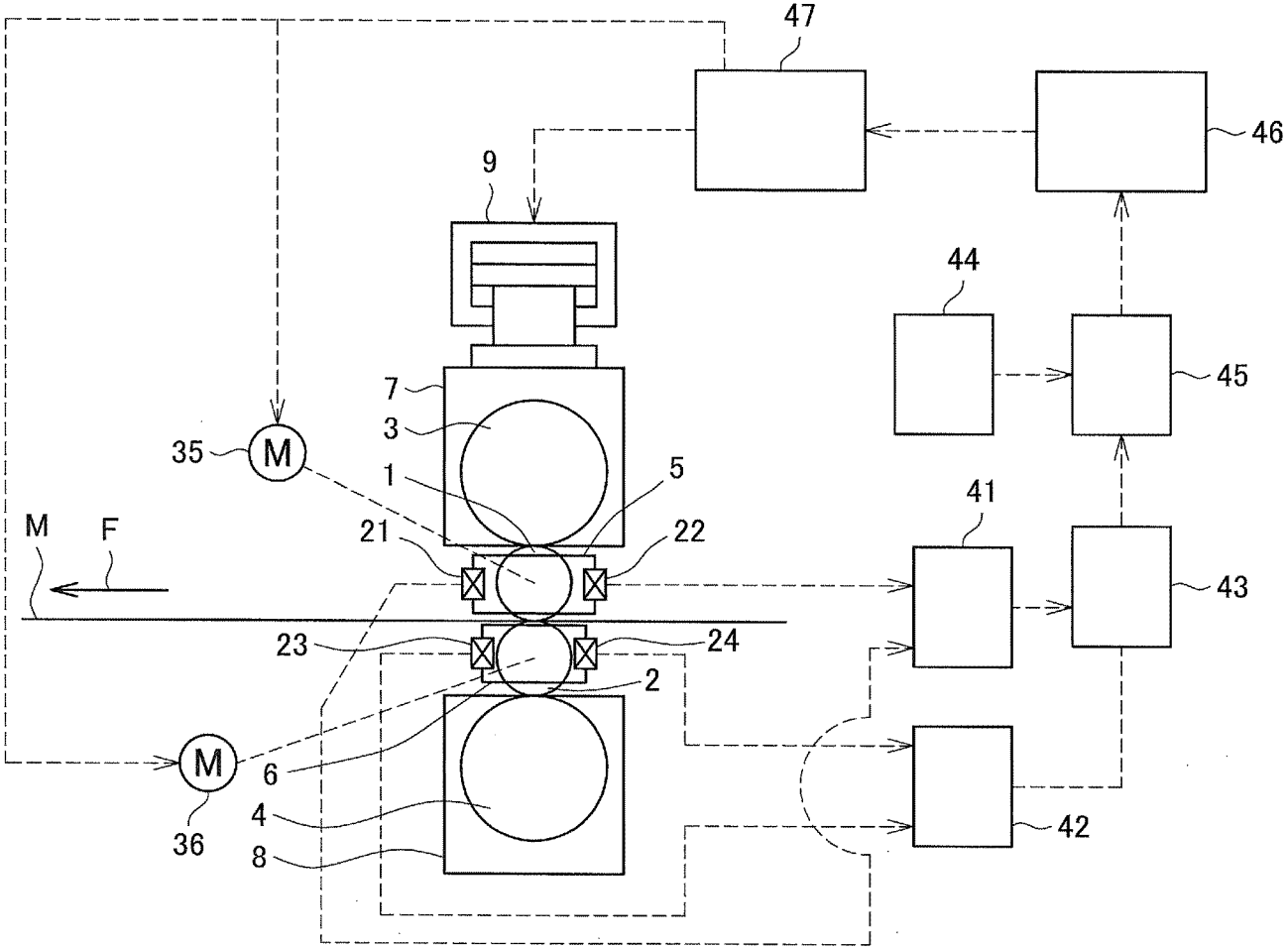

FIG. 6 is a view schematically showing a rolling apparatus according to a first embodiment of the present invention.

Figure 7:
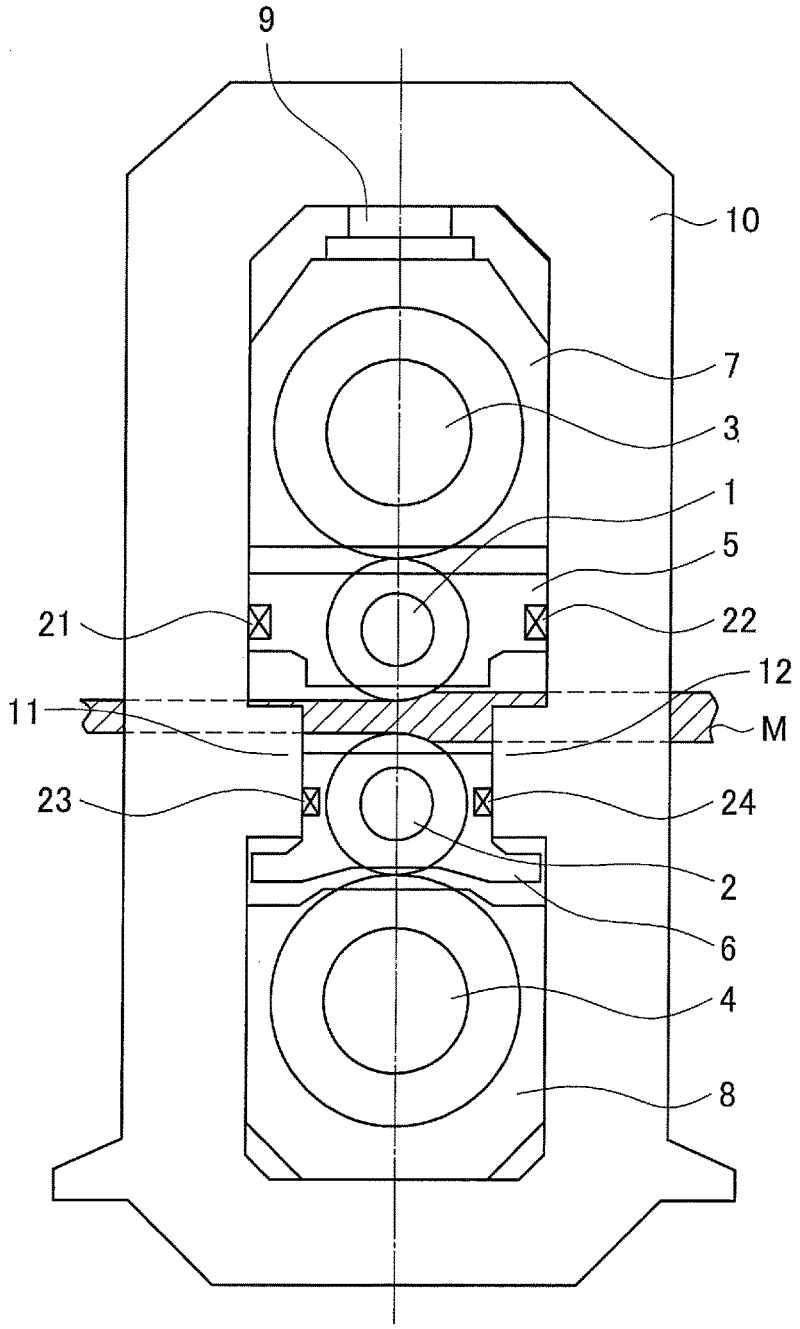

FIG. 7 is a side view schematically showing a main body of the rolling apparatus according to the same embodiment.

Figure 8:
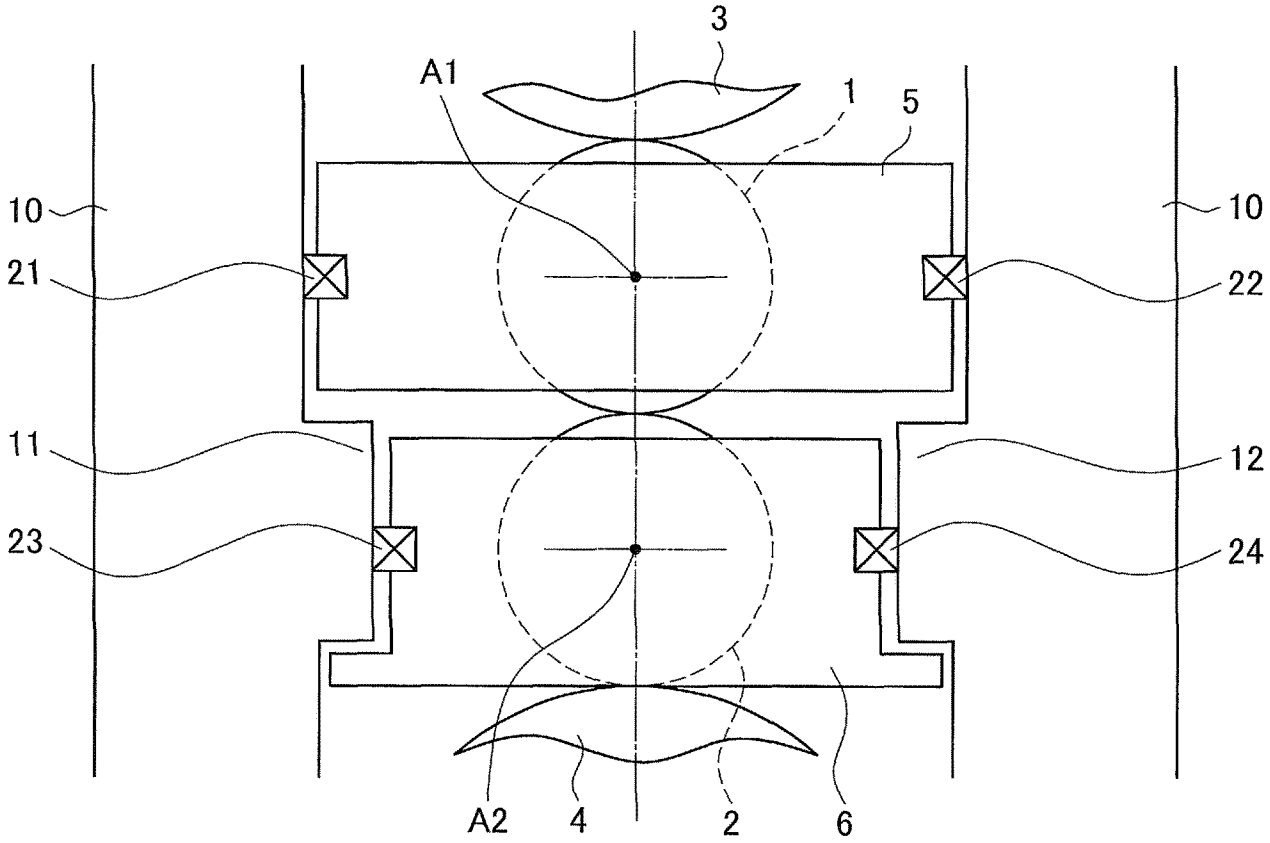

FIG. 8 is an enlarged side view of an upper work roll chock of the rolling apparatus shown in FIG. 6 and FIG. 7 and a periphery thereof.

Figure 9:
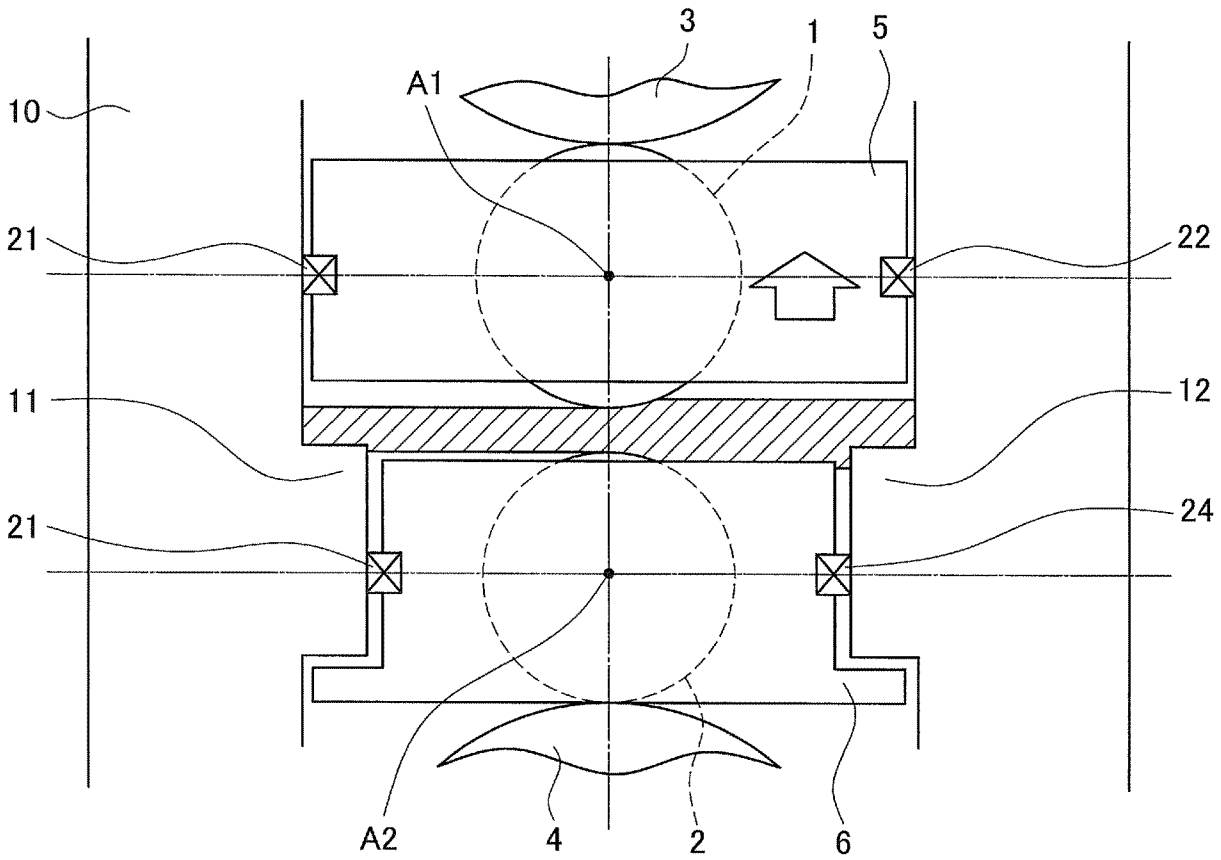

FIG. 9 is a side view illustrating functions and effects in measuring a rolling direction force by a rolling apparatus according to the same embodiment.

Figure 10:
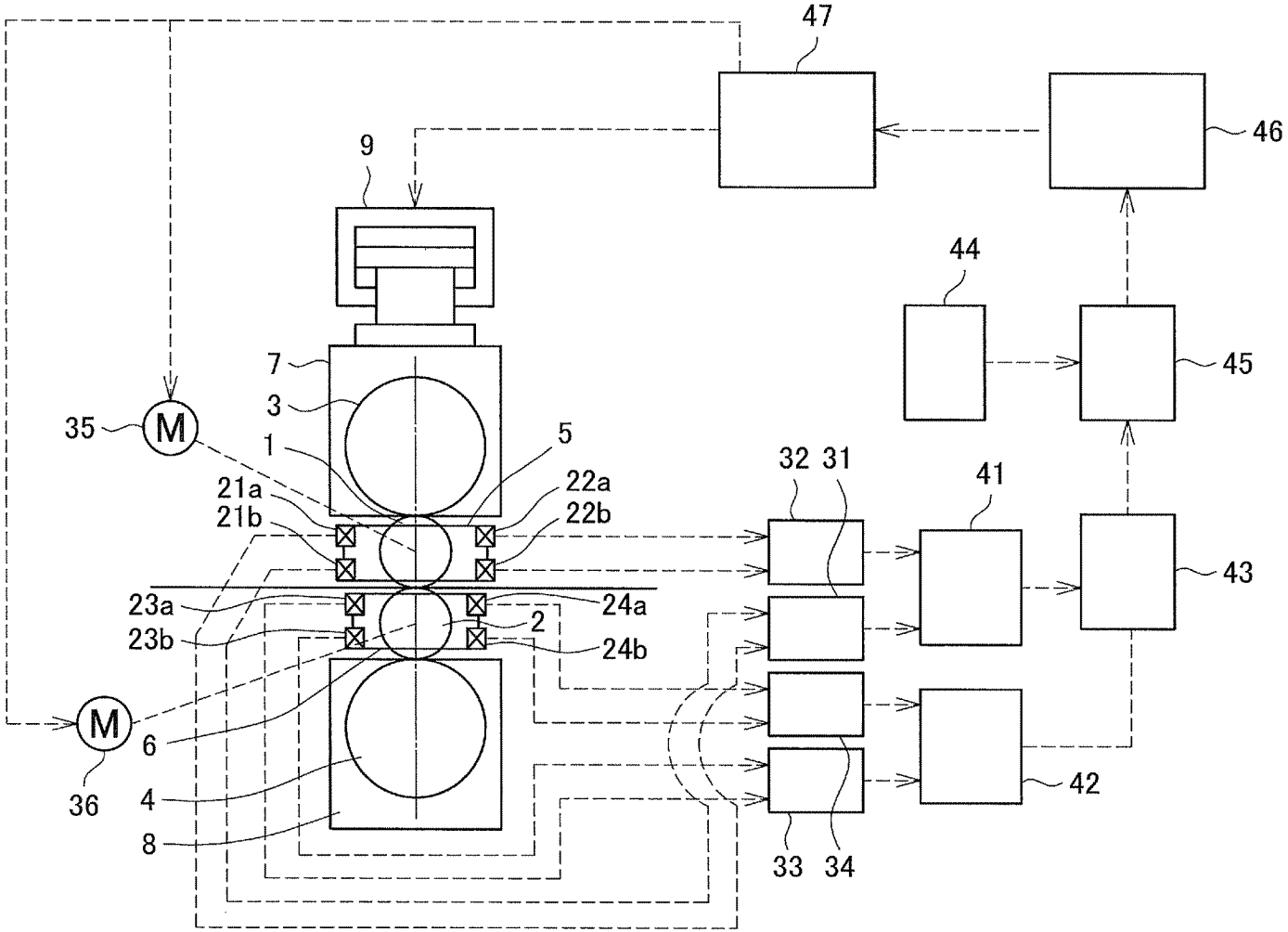

FIG. 10 is a view schematically showing a rolling apparatus according to a second embodiment of the present invention.

Figure 11:
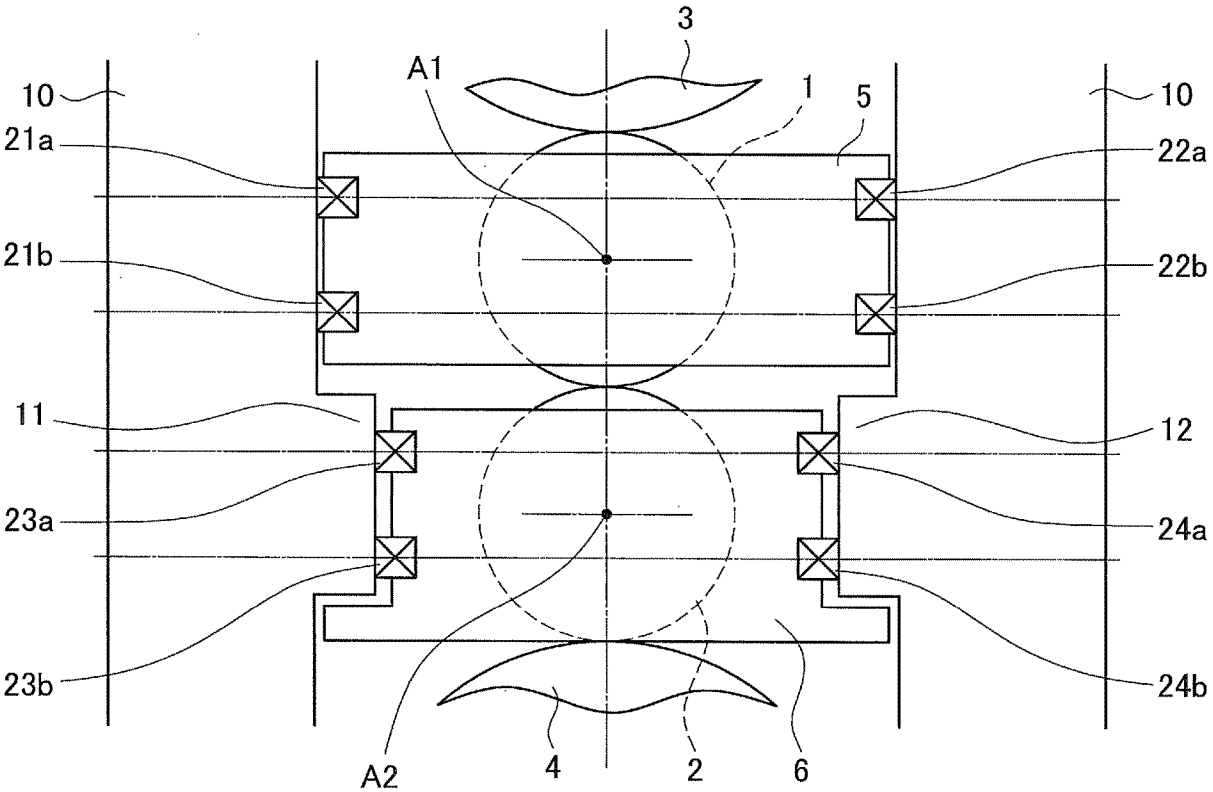

FIG. 11 is an enlarged side view of an upper work roll chock of the rolling apparatus shown in FIG. 10 and a periphery thereof.

Figure 12:
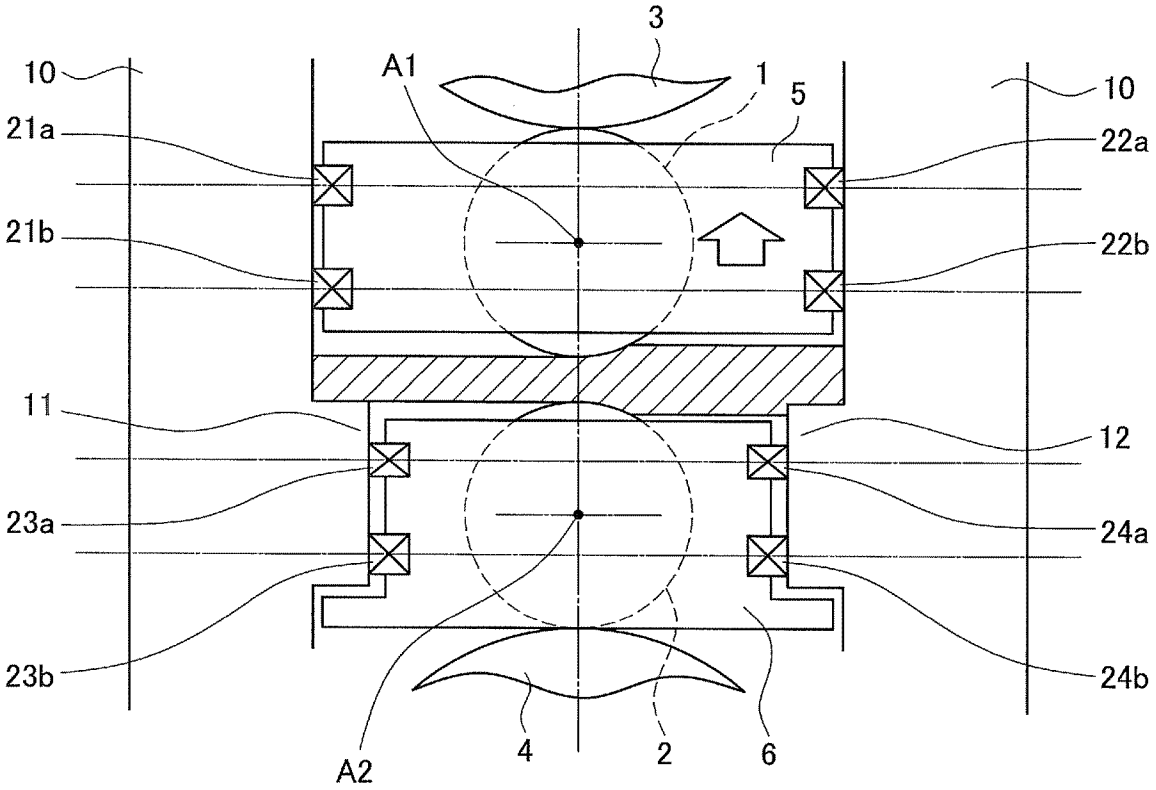

FIG. 12 is a side view illustrating functions and effects in measuring a rolling direction force by a rolling apparatus according to the same embodiment.

Figure 13:
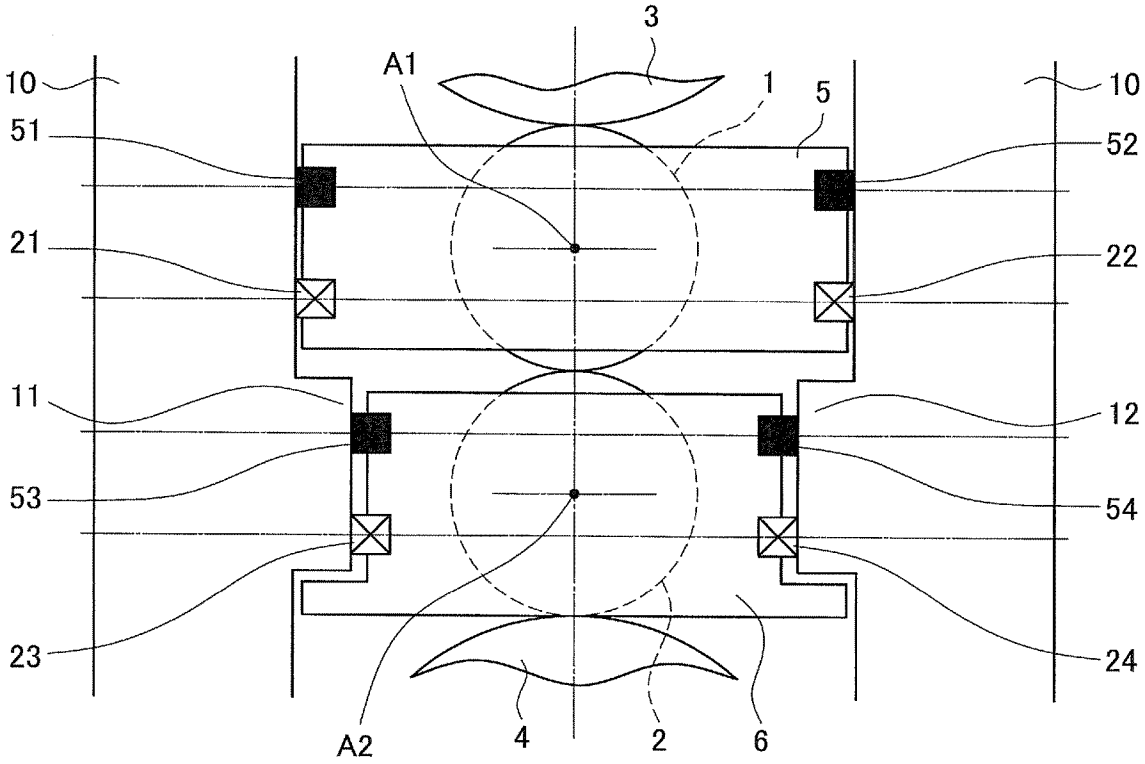

FIG. 13 is an enlarged side view of an upper work roll chock of a rolling apparatus according to a third embodiment of the present invention and a periphery thereof.

Figure 14:
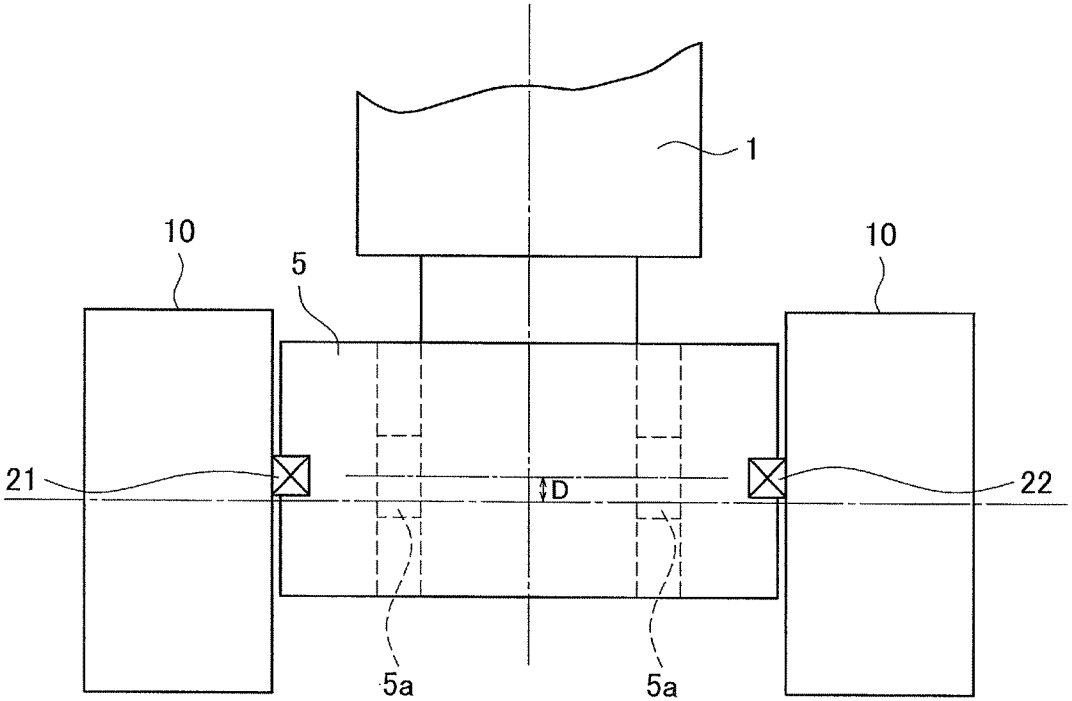

FIG. 14 is an enlarged plan view similar to FIG. 5 of an upper work roll chock of a rolling apparatus according to a fourth embodiment of the present invention and a periphery thereof.

Figure 15:
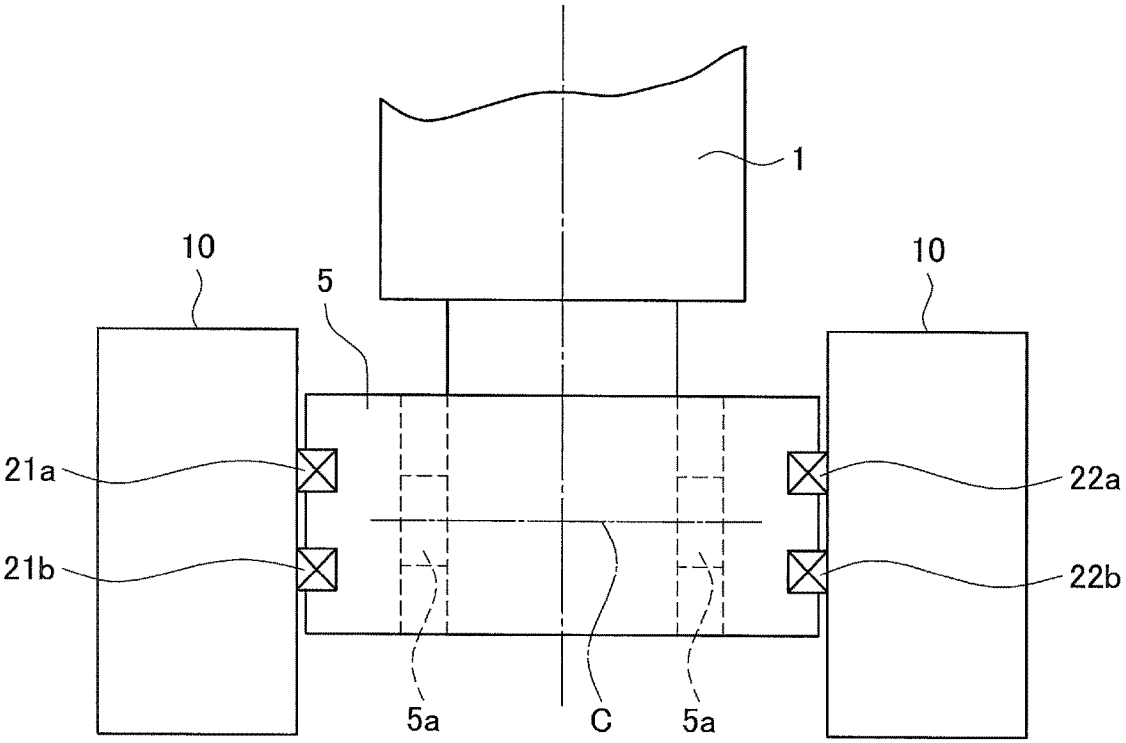

FIG. 15 is an enlarged plan view similar to FIG. 14 of an upper work roll chock of a rolling apparatus according to a fifth embodiment of the present invention and a periphery thereof.

Figure 16:
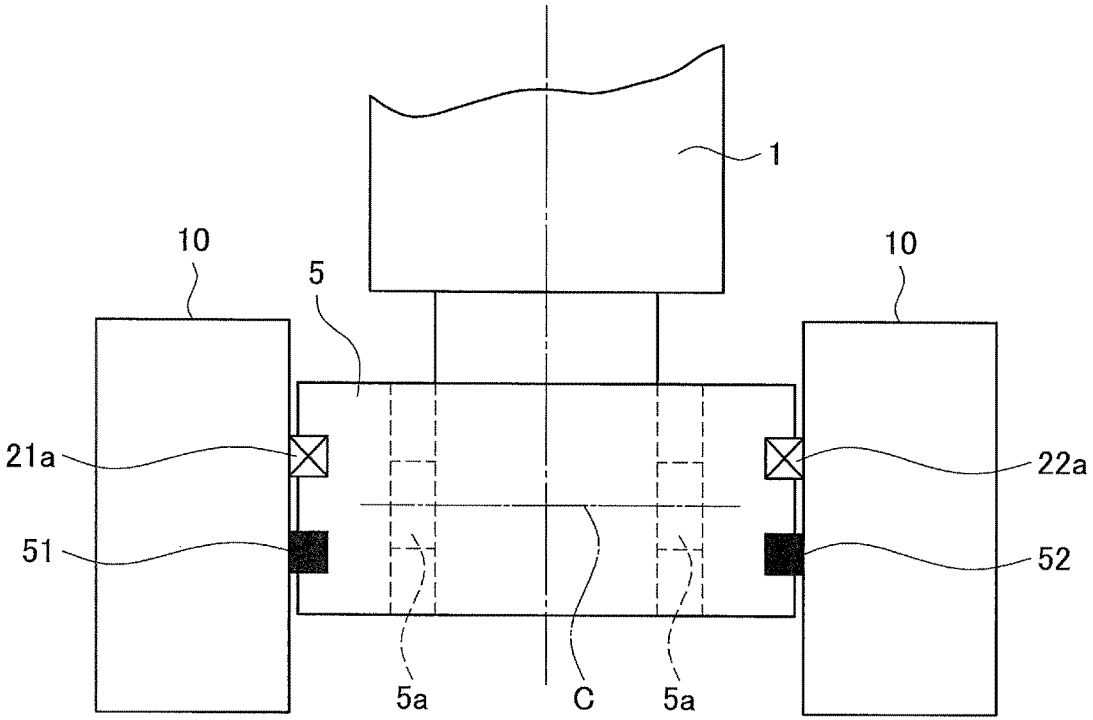

FIG. 16 is an enlarged plan view similar to FIG. 14 of an upper work roll chock of a rolling apparatus according to a sixth embodiment of the present invention and a periphery thereof.

Figure 17:
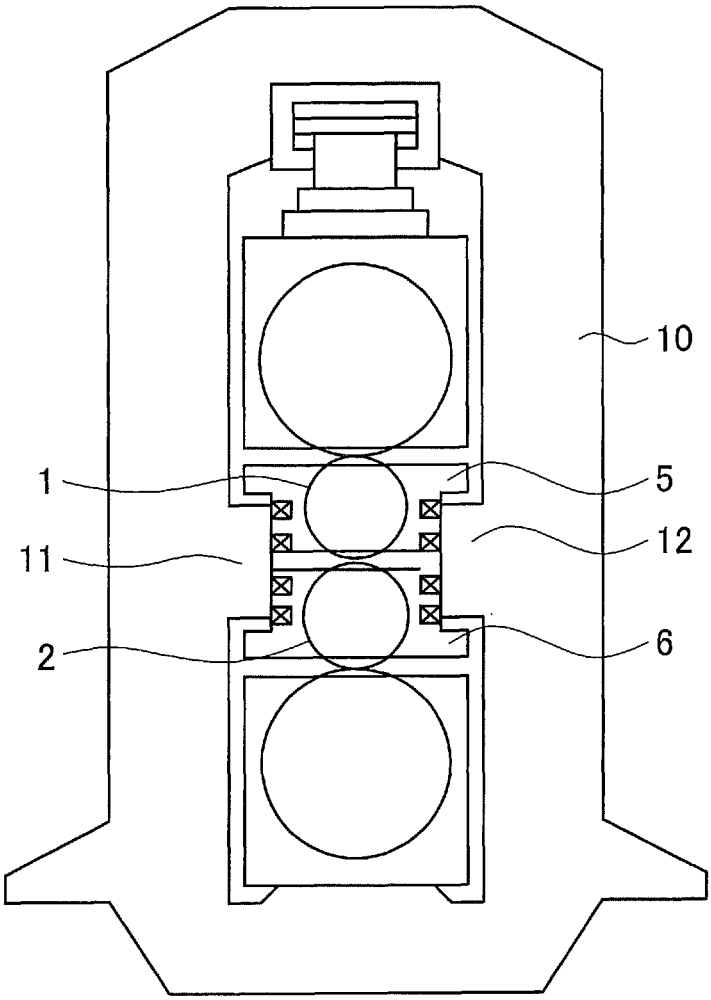

FIG. 17 is a side view showing a first modified example of a rolling apparatus according to an embodiment of the present invention.

Figure 18:
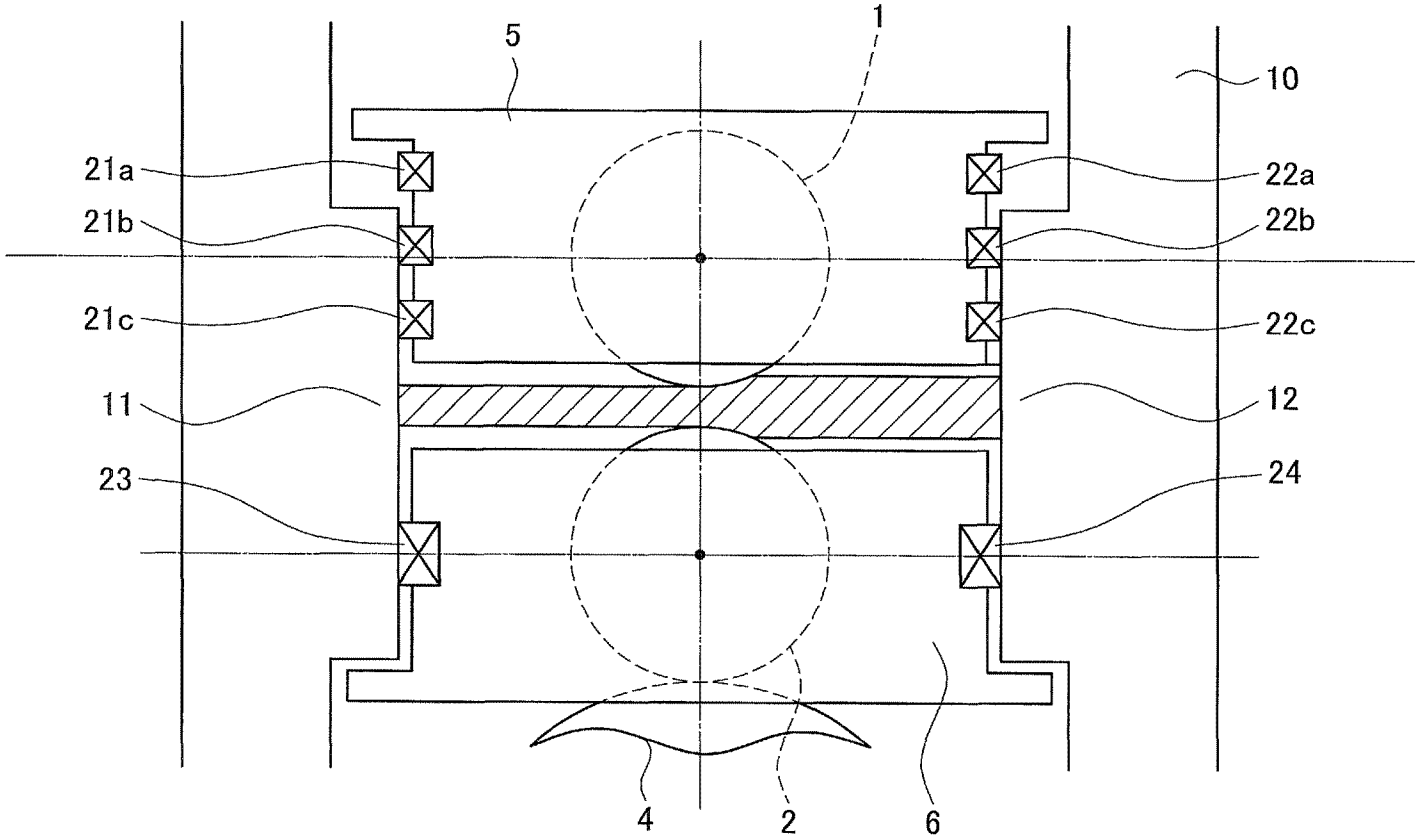

FIG. 18 is an enlarged side view showing another construction example of the rolling apparatus according to the first modified example shown in FIG. 17, and showing an upper work roll chock and a periphery thereof.

Figure 19:
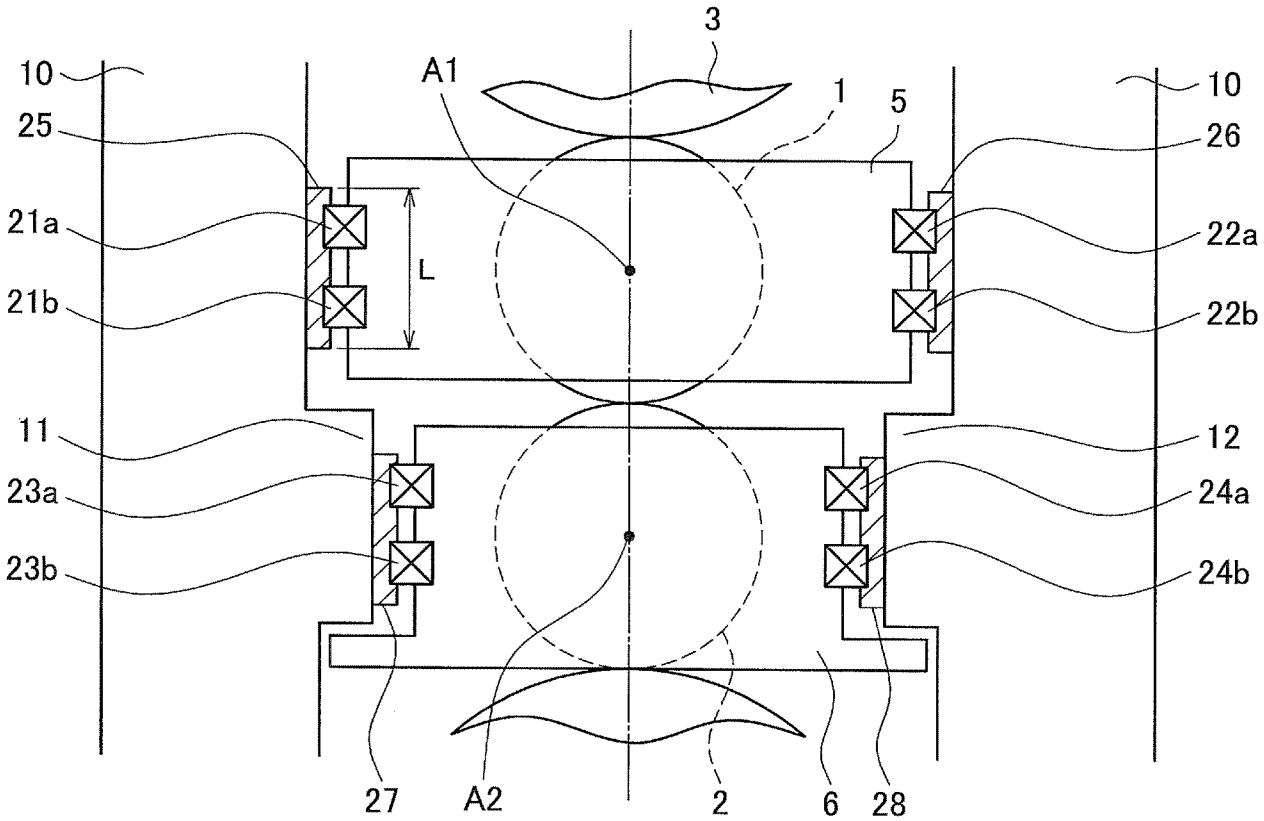

FIG. 19 is an enlarged side view showing a fourth modified example of a rolling apparatus according to an embodiment of the present invention, and showing an upper work roll chock and a periphery thereof having a construction in which a cover is provided over a plurality of load detection devices.

Figure 20:
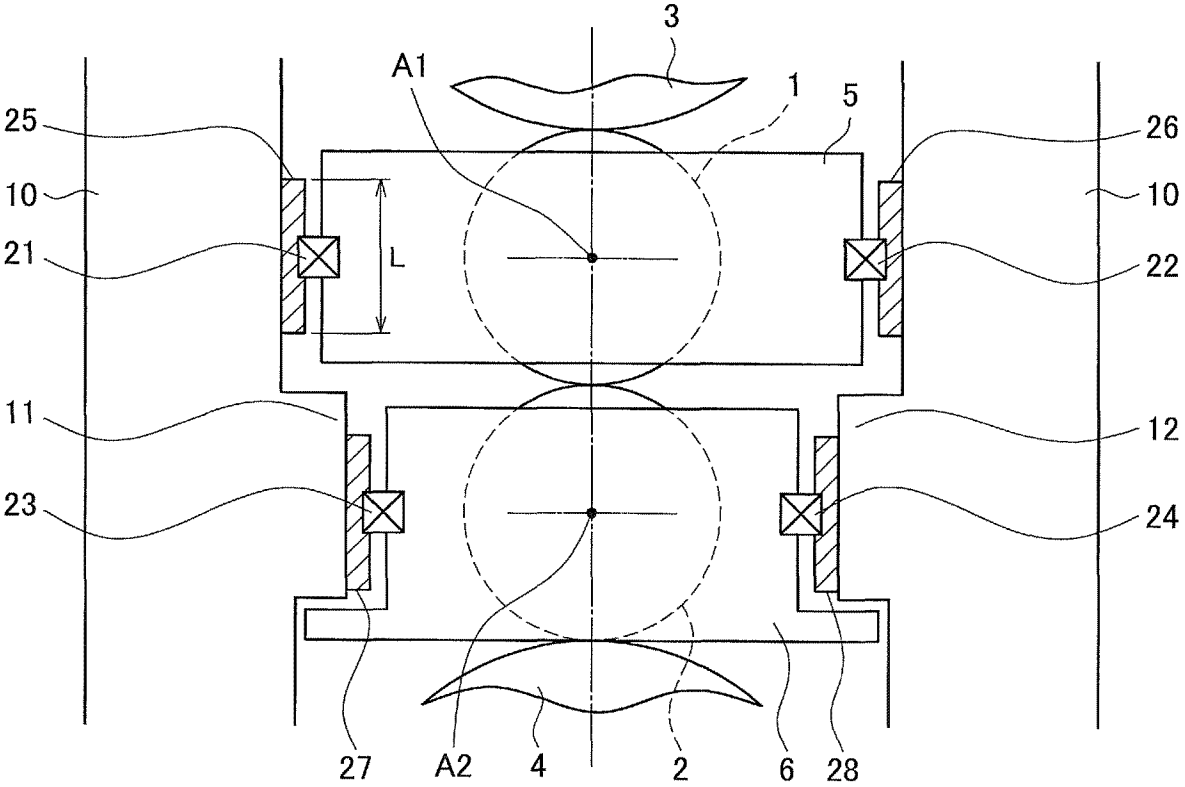

FIG. 20 is an enlarged side view showing a fourth modified example of a rolling apparatus according to an embodiment of the present invention, and showing an upper work roll chock and a periphery thereof having a construction in which a cover is provided over one load detection devices.

Figure 21:
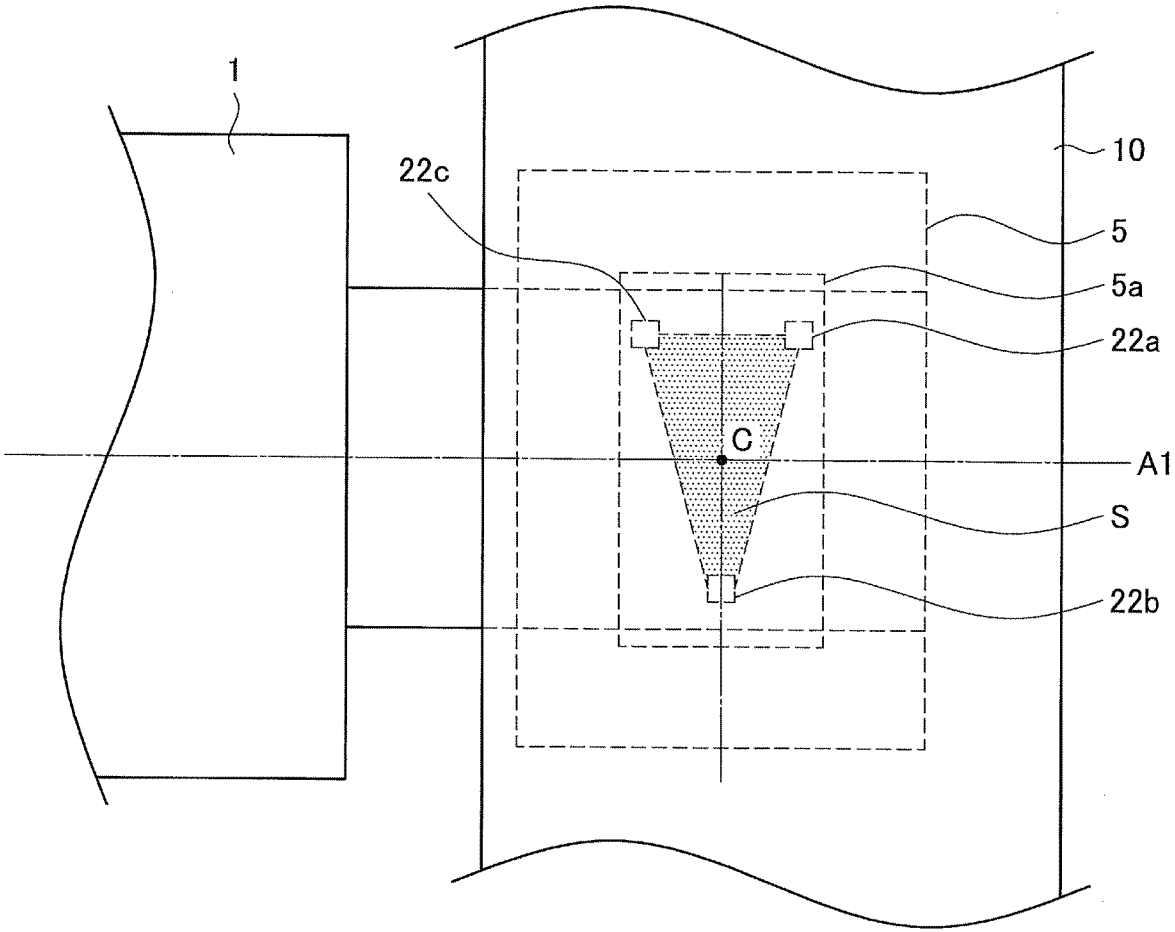

FIG. 21 is an elevational view showing an arrangement example in a case where a rolling apparatus according to an embodiment of the present invention has three load detection devices.

Figure 22:
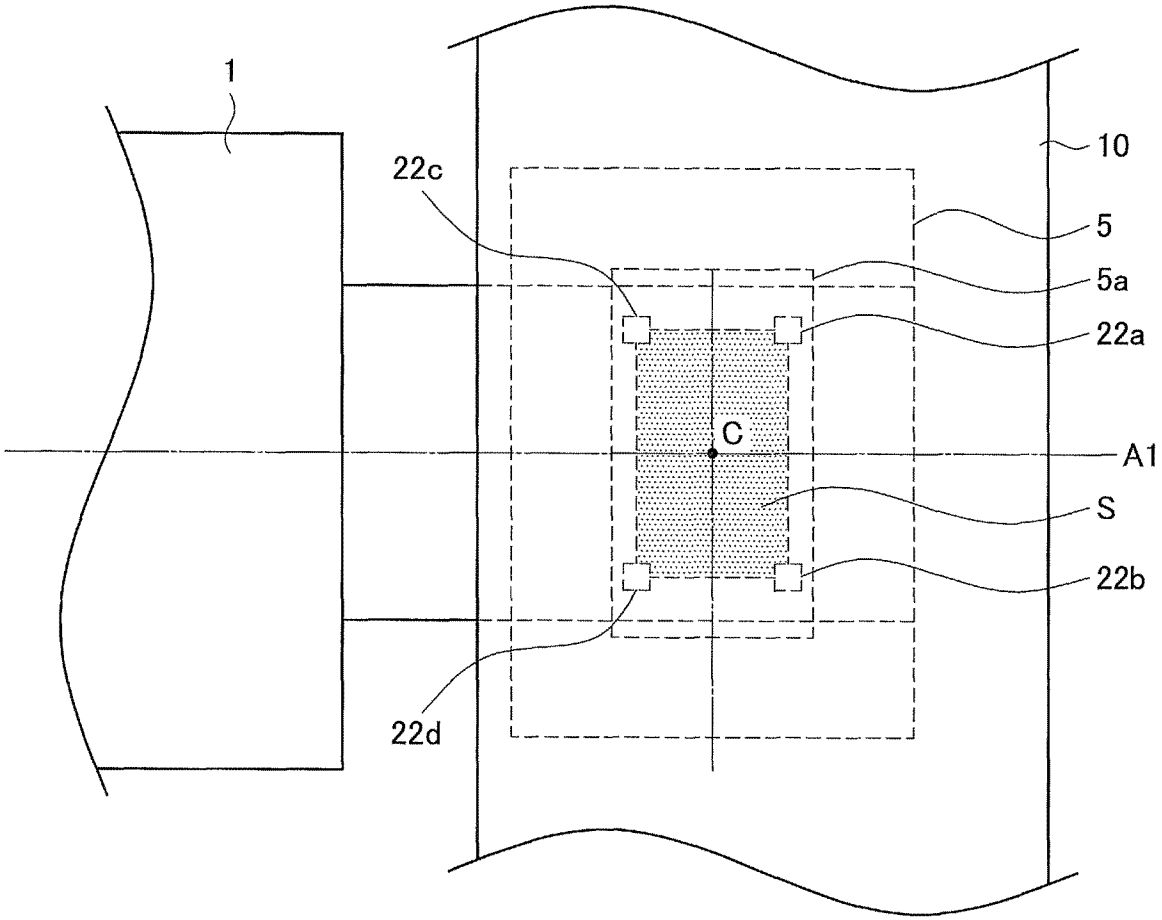

FIG. 22 is an elevational view showing an arrangement example in a case where a rolling apparatus according to an embodiment of the present invention has four load detection devices.

MODE(S) FOR CARRYING OUT THE INVENTION

Hereinafter, referring to the appended drawings, preferred embodiments of the present invention will be described in detail. It should be noted that, in the above description with reference to FIGS. 1 to 5 and the following description, structural elements that have substantially the same function and structure are denoted with the same reference numerals.

A rolling apparatus according to an embodiment of the present invention to be described below includes, in work roll chocks, load detection devices that detect loads in a rolling direction acting on the work roll chocks. In this case, the load detection devices are disposed so as to face housings or project blocks using a point of effort of one of the work rolls in a rolling direction force as a reference, such that a rotation moment generated on one of the work roll chocks caused by the rolling direction force is equal to a counter rotation moment generated by counterforce against the rotation moment. Here, the point of effort of the work roll in the rolling direction force is a roll axis of the work roll in a draft direction of the work roll, and is a center of a radial bearing provided on the work roll chock in a roll axis direction.

The rolling apparatus according to the present embodiment prevents the tilts of the work roll chocks by disposing each of the load detection devices in a manner that a point of effort in the rolling direction force is included within a range defined by one or multiple load detection devices. For example, each of the load detection devices is disposed in a manner that the point of effort of the rolling direction force is included within a range in which the housing or the project block faces the load detection device in the draft direction or in the roll axis direction. Alternatively, each of the load detection devices is disposed in a manner that a line extending in the rolling direction and including a point of effort of the rolling direction force of the work roll is interposed between at least two load detection devices all the time. In this way, the load detection device is capable of detecting the rolling direction force with high accuracy.

1. First Embodiment

FIG. 6 is a view schematically showing a rolling apparatus according to a first embodiment of the present invention. FIG. 7 is a side view schematically showing a main body of the rolling apparatus. In the same manner as the rolling apparatus shown in FIG. 1, the rolling apparatus shown in FIG. 6 and FIG. 7 includes an upper work roll 1 supported by an upper work roll chock 5, an upper backup roll 3 supported by an upper backup roll chock 7, a lower work roll 2 supported by a lower work roll chock 6, and a lower backup roll 4 supported by a lower backup roll chock 8. Further, the rolling apparatus shown in FIG. 6 and FIG. 7 includes a screw down device 9 that controls a gap between the upper and lower work rolls, and an upper drive electric motor 35 and a lower drive electric motor 36 that drive the upper and lower work rolls, respectively. A flat-rolled metal material M to be rolled by the rolling apparatus moves in a rolling direction F. Though FIG. 6 and FIG. 7 basically show only the apparatus construction on the operator side, similar devices exist on the driving side, too.

As shown in FIG. 7, in the present embodiment, a housing 10 is provided with an exit side project block 11 and an entry side project block 12. The exit side project block 11 and the entry side project block 12 are formed so as to protrude from the housing 10 towards the inner side of the rolling apparatus.

Further, in the same manner as the rolling apparatuses shown in FIGS. 1 to 5, the rolling apparatus shown in FIG. 6 and FIG. 7 includes load detection devices detecting loads acting on the housing 10 or the project blocks 11, 12 at the time of rolling a flat-rolled metal material.

As shown in FIG. 6 and FIG. 7, the rolling apparatus of the present embodiment is provided with four load detection devices 21, 22, 23, and 24 on the operator side. Note that the load detection devices are also provided on the driving side, the number of the detection devices being the same as the number of the detection devices on the operator side.

An upper work roll chock exit side load detection device 21 is provided in the upper work roll chock 5 on an exit side in the rolling direction in a manner that the upper work roll chock exit side load detection device 21 faces the housing 10 on the exit side in the rolling direction. The upper work roll chock exit side load detection device 21 detects a force acting between the housing 10 on the exit side and the upper work roll chock 5, that is, the upper work roll chock exit side load detection device 21 detects a rolling direction force acting on the upper work roll chock 5 in the rolling direction toward the exit side. An upper work roll chock entry side load detection device 22 is provided in the upper work roll chock 5 on an entry side in the rolling direction in a manner that the upper work roll chock entry side load detection device 22 faces the housing 10 on the entry side in the rolling direction. The upper work roll chock entry side load detection device 22 detects a force acting between the housing 10 on the entry side and the upper work roll chock 5, that is, the upper work roll chock entry side load detection device 22 detects a rolling direction force acting on the upper work roll chock 5 in the rolling direction toward the entry side.

In the same manner, a lower work roll chock exit side load detection device 23 is provided in the lower work roll chock 6 on an exit side in the rolling direction in a manner that the lower work roll chock exit side load detection device 23 faces the exit side project block 11 of the housing 10 on the exit side in the rolling direction. The lower work roll chock exit side load detection device 23 detects a force acting between the exit side project block 11 and the lower work roll chock 6, that is, the lower work roll chock exit side load detection device 23 detects a rolling direction force acting on the lower work roll chock 6 in the rolling direction toward the exit side. A lower work roll chock entry side load detection device 24 is provided in the lower work roll chock 6 on an entry side in the rolling direction in a manner that the lower work roll chock entry side load detection device 24 faces the entry side project block 12 of the housing 10 on the entry side in the rolling direction. The lower work roll chock entry side load detection device 24 detects a force acting between the entry side project block 12 and the lower work roll chock 6, that is, the lower work roll chock entry side load detection device 24 detects a rolling direction force acting on the lower work roll chock 6 in the rolling direction toward the entry side.

FIG. 8 is an enlarged schematic side view of an upper work roll chock 5 of the rolling apparatus shown in FIG. 6 and FIG. 7 and a periphery thereof. As seen in FIG. 8, the positions (heights) in the draft direction of the respective load detection devices 21 and 22 for the upper work roll chock 5 are the same as the position (height) in the draft direction of a roll axis A1 of the upper work roll 1 held by the upper work roll chock 5, and the positions (heights) in the draft direction of the respective load detection devices 23 and 24 for the lower work roll chock 6 are the same as the position (height) in the draft direction of a roll axis A2 of the lower work roll 2 held by the lower work roll chock 6.

The thus disposed load detection devices 21, 22, 23, and 24 can directly detect the rolling direction forces applied to the respective work roll chocks 5 and 6. That is, the load detection devices 21 and 22 for the upper work roll chock 5 detect a rolling direction force applied to the upper work roll chock 5 toward the exit side and a rolling direction force applied to the upper work roll chock 5 toward the entry side, respectively. Further, the load detection devices 23 and 24 for the lower work roll chock 6 detect a rolling direction force applied to the lower work roll chock 6 toward the exit side and a rolling direction force applied to the lower work roll chock 6 toward the entry side, respectively.

Next, functions and effects of the thus constructed rolling apparatus will be described.

Taking the upper work roll chock 5 as an example, as described above, the heights of the load detection devices 21 and 22 for the upper work roll chock 5 in the draft direction are the same as the height of the roll axis A1 of the upper work roll 1 in the draft direction. Accordingly, the height at which a load is applied from the upper work roll 1 to the upper work roll chock 5 is the same as the height at which a load is applied from the upper work roll chock 5 to the housing 10.

For this reason, no moment is generated on the upper work roll chock 5, and hence, the rotation and the tilt of the upper work roll chock 5 can be prevented. As a result, the load detection devices 21 and 22 can each accurately detect the rolling direction force applied to the upper work roll chock 5.

Further, for example, as shown in FIG. 9, there is a case where the upper work roll 1 moves upward and a gap between the work rolls 1 and 2 increases. Alternatively, the work rolls 1 and 2 and the backup rolls 3 and 4 may worn away, and thus decrease in the roll diameters. Even in those cases, since the relative position in the draft direction between the load detection device 21 and 22 for the upper work roll chock 5 and the roll axis A1 of the upper work roll 1 does not change, the height of the load detection devices 21 and 22 for the upper work roll chock 5 remains the same as the height of the roll axis A1 of the upper work roll 1. Accordingly, even in this case, no moment is generated on the upper work roll chock 5. As a result, the load detection devices 21 and 22 can each accurately detect the rolling direction force applied to the upper work roll chock 5.

Note that, although in the present embodiment the heights of the load detection devices in the draft direction of the work roll are the same as the height of the roll axis in the draft direction of the work roll, the heights may not be exactly the same. In this case, the point of effort of the rolling direction force may be located within a range in which the load detection device is in contact with the housing or the project block. Further, in the present embodiment, only one load detection device is provided on each of the exit and entry sides of each work roll chock in the rolling direction. However, multiple load detection devices may also be disposed in a manner that the load detection devices are shifted from each other in the roll axis direction on each of the exit and entry sides of each work roll chock in the rolling direction.

2. Second Embodiment

Next, with reference to FIGS. 10 to 12, a second embodiment of the present invention will be described. A construction of a rolling apparatus according to the present embodiment is basically the same as the construction of the rolling apparatus according to the first embodiment. However, while the rolling apparatus according to the first embodiment includes load detection devices provided to each work roll chock at one certain height, the rolling apparatus according to the present embodiment includes multiple load detection devices provided in the draft direction.

As shown in FIG. 10 and FIG. 11, the rolling apparatus according to the present embodiment includes eight load detection devices on the operator side. Note that the detection devices are also provided to the driving side, the number of the detection devices being the same as the number of the detection devices on the operator side. A first load detection device 21*a* and a second load detection device 21*b* on the exit side of the upper work roll chock are provided in the upper work roll chock 5 on the exit side in the rolling direction in a manner that the first load detection device 21*a* and the second load detection device 21*b* face the housing 10 on the exit side in the rolling direction. The load detection devices 21*a* and 21*b* each detect a force acting between the housing 10 on the exit side and the upper work roll chock 5. In particular, the load detection device 21*a* and the load detection device 21*b* are disposed in the draft direction, one above the other. In this case, the load detection devices 21*a* and 21*b* are disposed in a manner that a line extending in the rolling direction and including a roll axis A1, which is a point of effort of the rolling direction force of the upper work roll 1 in the draft direction of the upper work roll 1, is interposed between the load detection devices 21*a* and 21*b*.

For example, as shown in FIG. 11, in the present embodiment, the load detection device 21*a* is disposed above (at a position higher than the position of) the roll axis A1 of the upper work roll 1 in the draft direction, and the load detection device 21*b* is disposed below (at a position lower than the position of) the roll axis A1 of the upper work roll 1 in the draft direction.

The thus constructed load detection devices 21*a* and 21*b* are connected to an upper work roll chock exit side load calculation device 31 as shown in FIG. 10. The load calculation device 31 adds up a load detected by the load detection device 21*a* and a load detected by the load detection device 21*b*. The total value of those detected loads corresponds to a rolling direction force applied to the housing 10 on the exit side from the upper work roll chock 5, that is, a rolling direction force of the upper work roll chock 5 toward the exit side.

In the same manner, a first load detection device 22*a* and a second load detection device 22*b* on the entry side of the upper work roll chock are provided in the upper work roll chock 5 on the entry side in the rolling direction in a manner that the first load detection device 22*a* and the second load detection device 22*b* face the housing 10 on the entry side in the rolling direction. The load detection devices 22*a* and 22*b* each detect a force acting between the housing 10 on the entry side and the upper work roll chock 5. In particular, the load detection devices 22*a* and 22*b* are disposed in the draft direction, one above the other, in the same manner as the above-described load detection devices 21*a* and 21*b*.

The thus constructed load detection devices 22*a* and 22*b* are connected to an upper work roll chock entry side load calculation device 32 as shown in FIG. 10. The load calculation device 32 adds up loads detected by the load detection devices 22*a* and 22*b*. In this way, a rolling direction force applied to the housing 10 on the entry side from the upper work roll chock 5, that is, a rolling direction force of the upper work roll chock 5 toward the entry side is calculated.

In the same manner, a first load detection device 23*a* and a second load detection device 23*b* on the exit side of the lower work roll chock are provided in the lower work roll chock 6 on the exit side in the rolling direction in a manner that the first load detection device 23*a* and the second load detection device 23*b* face the housing 10 on the exit side in the rolling direction. The load detection devices 23*a* and 23*b* each detect a force acting between the exit side project block 11 and lower work roll chock 6. In particular, the load detection devices 23*a* and 23*b* are disposed in the draft direction, one above the other, in the same manner as the above-described load detection devices 21*a* and 21*b*.

The load detection devices 23*a* and 23*b* are connected to a lower work roll chock exit side load calculation device 33 as shown in FIG. 10. The load calculation device 33 adds up loads detected by the load detection devices 23*a* and 23*b*. In this way, a rolling direction force applied to the exit side project block 11 from the lower work roll chock 6, that is, a rolling direction force of the lower work roll chock 6 towards the exit side is calculated.

In the same manner, a first load detection device 24*a* and a second load detection device 24*b* on the entry side of the lower work roll chock are provided in the lower work roll chock 6 on the entry side in the rolling direction in a manner that the first load detection device 24*a* and the second load detection device 24*b* face the housing 10 on the entry side in the rolling direction. The load detection devices 24*a* and 24*b* each detect a force acting between the entry side project block 12 and the lower work roll chock 6. In particular, the load detection devices 24*a* and 24*b* are disposed in the draft direction, one above the other, in the same manner as the above-described load detection devices 21*a* and 21*b*.

The load detection devices 24*a* and 24*b* are connected to a lower work roll chock entry side load calculation device 34 as shown in FIG. 10. The load detection device 34 adds up loads detected by the load detection devices 24*a* and 24*b*. In this way, a rolling direction force applied to the entry side project block 12 from the lower work roll chock 6, that is, a rolling direction force of the lower work roll chock 6 towards the entry side is calculated.

Next, functions and effects of the thus constructed rolling apparatus according to the second embodiment will be described.

Taking the upper work roll chock 5 as an example, as described above, both of the load detection devices 21*a* and 21*b* are disposed in the upper work roll chock 5 on the exit side in the rolling direction. Accordingly, a side surface of the exit side of the upper work roll chock 5 is supported at multiple points in the draft direction, particularly at both above and below the roll axis A1 of the upper work roll 1. In the same manner, both of the load detection devices 22*a* and 22*b* are disposed in the upper work roll chock 5 on the entry side in the rolling direction. Accordingly, a side surface of the entry side of the upper work roll chock 5 is supported at multiple points in the draft direction, particularly at both above and below the roll axis A1 of the upper work roll 1.

Accordingly, even if a rolling direction force is applied to the upper work roll chock 5 from the upper work roll 1, the upper work roll chock 5 does not rotate or tilt. As a result, the load detection devices 21*a*, 21*b*, 22*a*, and 22*b* can each accurately detect the rolling direction force applied to the upper work roll chock 5.

Further, for example, as shown in FIG. 12, even in the case where the upper work roll 1 moves upward and a gap between the work rolls 1 and 2 increases, or where the work rolls 1 and 2 and the backup rolls 3 and 4 worn away, and thus decrease in the roll diameters, the relative position relationship between the load detection devices 21*a*, 21*b*, 22*a*, and 22*b* and the roll axis A1 of the upper work roll 1 does not change. Therefore, even in such a case, no moment is generated on the upper work roll chock 5. As a result, the load detection devices 21*a*, 21*b*, 22*a*, and 22*b* can each accurately detect the rolling direction forces applied to the upper work roll chock 5.

Note that the rolling apparatus according to the present embodiment is provided with two load detection devices in the draft direction, one above the other, on each of the exit and entry sides of each work roll chock in the rolling direction. However, the number of the load detection devices is not necessarily two, and, on each of the exit and entry sides of each work roll chock in the rolling direction, there may be provided three or more load detection devices disposed in a manner that the three or more load detection devices are shifted from each other in the draft direction. In this case, it is preferred that, out of those multiple load detection devices, at least one of the load detection devices be disposed above a roll axis of the corresponding work roll in the draft direction and at least one of the load detection device be disposed below a roll axis of the corresponding work roll in the draft direction all the time.

3. Third Embodiment

Next, with reference to FIG. 13, a third embodiment of the present invention will be described. A construction of a rolling apparatus according to the third embodiment is basically the same as the construction of the rolling apparatus according to the second embodiment. However, while the rolling apparatus according to the second embodiment includes two load detection devices provided on each of the exit and entry sides of each work roll chock in the rolling direction, the rolling apparatus according to the present embodiment includes one load detection device and one dummy block (protruding part).

As shown in FIG. 13, the rolling apparatus according to the present embodiment includes four load detection devices and four dummy blocks. An upper work roll chock exit side load detection device 21 and an upper work roll chock exit side dummy block 51 are provided on the exit side of the upper work roll chock 5 in the rolling direction. In this case, one of the load detection device 21 and the dummy block 51 is disposed above a roll axis A1 of the upper work roll 1 in the draft direction, and the other is disposed below the roll axis A1 in the draft direction. In FIG. 13, the dummy block 51 is disposed above the roll axis A1 of the upper work roll 1 in the draft direction, and the load detection device 21 is disposed below the roll axis A1 in the draft direction. That is, the load detection device 21 and the dummy block 51 are disposed so as to be shifted from each other in the draft direction, one above the other.

Further, as seen in FIG. 13, the load detection device 21 is slightly protruded from the side surface of the exit side of the upper work roll chock 5, and the dummy block 51 is also slightly protruded from the side surface of the exit side of the upper work roll chock 5, the amount of protrusion being the same as the amount of protrusion of the load detection device 21.

In the same manner, an upper work roll chock entry side load detection device 22 and an upper work roll chock entry side dummy block 52 are provided on the entry side of the upper work roll chock 5 in the rolling direction. Further, a lower work roll chock exit side load detection device 23 and a lower work roll chock exit side dummy block 53 are provided on the exit side of the lower work roll chock 6 in the rolling direction. A lower work roll chock entry side load detection device 24 and a lower work roll chock entry side dummy block 54 are provided on the entry side of the lower work roll chock 6 in the rolling direction.

Taking the upper work roll chock 5 as an example, in the present embodiment, the upper work roll chock exit side load detection device 21 and the upper work roll chock entry side load detection device 22 in particular are disposed such that the height in the draft direction of the upper work roll chock exit side load detection device 21 and the height in the draft direction of the upper work roll chock entry side load detection device 22 are the same as each other. In the same manner, the upper work roll chock exit side dummy block 51 and the upper work roll chock entry side dummy block 52 are disposed such that the height in the draft direction of the upper work roll chock exit side dummy block 51 and the height in the draft direction of the upper work roll chock entry side dummy block 52 are the same as each other.

Next, functions and effects of the thus constructed rolling apparatus will be described taking the upper work roll chock 5 as an example.

In the thus constructed rolling apparatus, it is known in advance that the length in the draft direction from the load detection device 21 to the roll axis A1 of the work roll 1 and the length in the draft direction from the dummy block 51 to the roll axis A1 are fixed. In other words, a moment arm in the upper work roll chock 5 is fixed and is known in advance. Accordingly, in the case where a force is applied from the upper work roll 1 to the upper work roll chock 5 on the exit side in the rolling direction, for example, distribution of the loads applied to the load detection device 21 and the dummy block 51 is also fixed and is also known in advance. Therefore, by detecting only the load applied to the load detection device 21, both the loads applied to the load detection device 21 and the dummy block 51 can be detected/estimated. As a result, the rolling direction force applied from the upper work roll chock 5 to the housing 10 can be measured.

Further, in the same manner as the rolling apparatus according to the second embodiment, even if a rolling direction force is applied to the upper work roll chock 5 from the upper work roll 1, the upper work roll chock 5 does not rotate or tilt. Accordingly, the load detection devices 21 and 22 can each accurately detect the rolling direction force applied to the upper work roll chock 5. In addition, since the number of load detection devices can be reduced to half of the number of load detection devices shown in the second embodiment, the manufacturing cost can also be reduced.

Note that, in the present embodiment, the exit side load detection devices 21 and 23 and the entry side load detection devices 22 and 24 are disposed such that the height of the exit side load detection device 21 and the height of the entry side load detection device 22 are the same as each other, and the height of the exit side load detection device 23 and the height of the entry side load detection device 24 are the same as each other. However, the load detection devices can each appropriately measure a rolling direction force even if the heights in the draft direction are shifted, and hence are not necessarily disposed at the same height.

Further, in the example shown in FIG. 13, each load detection device and the corresponding dummy block are disposed such that the interval between the height of the load detection device and the height of the roll axis is equal to the interval between the height of the dummy block and the height of the roll axis. However, even if the intervals are not equal to each other, the respective intervals (moment arms) are known in advance and the rolling direction forces can be appropriately estimated on the basis of the outputs of the load detection devices, and hence, the intervals are not necessarily be equal to each other.

Accordingly, for example, the upper work roll chock exit side load calculation device 31 connected to the upper work roll chock exit side load detection device 21 calculates a rolling direction force on the basis of a load detected by the load detection device 21, an interval in the draft direction between the axis A1 of the upper work roll 1 and the load detection device 21, and an interval in the draft direction between the axis A1 of the upper work roll 1 and the dummy block 51.

4. Fourth Embodiment

Next, with reference to FIG. 14, a fourth embodiment of the present invention will be described. A construction of a rolling apparatus according to the present embodiment is basically the same as the construction of the rolling apparatus according to the first embodiment. However, in the rolling apparatus according to the present embodiment, each load detection device is disposed on the center of the radial bearing 5*a* of each work roll chock in the roll axis direction.

FIG. 14 is an enlarged plan view of the upper work roll chock 5 according to the present embodiment and a periphery thereof, which is similar to the cross-sectional plan view of FIG. 5. As seen in FIG. 14, the load detection devices 21 and 22 for the upper work roll chock 5 are disposed in a manner that the positions of the load detection devices 21 and 22 in the roll axis direction are located on the center of the radial bearing 5*a* of the upper work roll chock 5. Note that, although only the upper work roll chock 5 is shown in the example of FIG. 14, the lower work roll chock 6 may also have the load detection devices 23 and 24 arranged therein in the similar manner.

In the thus constructed rolling apparatus according to the present embodiment, even if the upper work roll chock 5 moves for a shift quantity D in the roll axis direction, the relative position between the load detection devices 21 and 22 and the radial bearing 5*a* does not change. That is, the load detection devices 21 and 22 are located on the center of the radial bearing 5*a* of the upper work roll chock 5 in the roll axis direction. Therefore, no moment is generated within a horizontal plane in the upper work roll chock 5. Accordingly, the rotation and the tilt of the upper work roll chock 5 can be prevented. As a result, the load detection devices 21 and 22 can accurately detect the rolling direction forces applied to the upper work roll chock 5.

Note that, although in the present embodiment the position of the load detection device is the same as the position of the center of the radial bearing in the roll axis direction of the work roll, the positions may not be exactly the same. In this case, the point of effort of the rolling direction force may be located within a range in which the load detection device is in contact with the housing or the project block. Further, in the present embodiment, only one load detection device is provided on each of the exit and entry sides of each work roll chock in the rolling direction. However, multiple load detection devices may also be disposed in a manner that the load detection devices are shifted from each other in the roll axis direction on each of the exit and entry sides of each work roll chock in the rolling direction.

Further, the rolling apparatus according to the present embodiment can be combined with the rolling apparatuses according to the first to third embodiments. For example, in the case where the first embodiment is combined with the fourth embodiment, the position in the draft direction of each of the load detection devices is the same as the position in the draft direction of the roll axis of a corresponding one of the work rolls supported by a corresponding one of the work roll chocks, the roll axis being the center of the radial bearing of the work roll chock in the roll axis direction.

5. Fifth Embodiment

Next, with reference to FIG. 15, a fifth embodiment of the present invention will be described. A construction of a rolling apparatus according to the present embodiment is basically the same as the construction of the rolling apparatus according to the fourth embodiment. However, while the rolling apparatus according to the fourth embodiment includes only one load detection device on the center of the radial bearing of the work roll chock in the roll axis direction, the rolling apparatus according to the present embodiment includes multiple load detection devices disposed in a manner that the load detection devices are shifted from each other in the roll axis direction.

As shown in FIG. 15, in the present embodiment, four load detection devices are provided with respect to the upper work roll chock 5. A first load detection device 21*a* and a second load detection device 21*b* on the exit side of the upper work roll chock are provided in the upper work roll chock 5 on the exit side in the rolling direction in a manner that the first load detection device 21*a* and the second load detection device 21*b* face the housing 10 on the exit side in the rolling direction. The load detection devices 21*a* and 21*b* each detect a force acting between the housing 10 on the exit side and the upper work roll chock 5. In particular, the load detection devices 21*a* and 21*b* are arranged in the roll axis direction.

In particular, in the present embodiment, the load detection device 21*a* is disposed at an inner side (to which the work roll 1 extends) with respect to the center C of the radial bearing 5*a* of the upper work roll chock 5 in the roll axis direction. On the other hand, the load detection device 21*b* is disposed at an outer side (opposite to which the work roll 1 extends) with respect to the center C of the radial bearing 5*a* in the roll axis direction.

In the same manner, a first load detection device 22*a* and a second load detection device 22*b* on the entry side of the upper work roll chock are provided in the upper work roll chock 5 on the entry side in the rolling direction in a manner that the first load detection device 22*a* and the second load detection device 22*b* face the housing 10 on the entry side in the rolling direction. The load detection devices 22*a* and 22*b* each detect a force acting between the housing 10 on the entry side and the upper work roll chock 5. In particular, the load detection device 22*a* and the load detection device 22*b* are arranged in the roll axis direction. Note that, although only the upper work roll chock 5 is shown in FIG. 15, the lower work roll chock 6 may also have load detection devices 23*a*, 23*b*, 24*a*, and 24*b* disposed therein in the similar manner.

In the thus constructed rolling apparatus according to the present embodiment, even if the upper work roll chock 5 moves in the roll axis direction, a side surface of the exit side of the upper work roll chock 5 is supported all the time at multiple points in the roll axis direction in a manner that the center C of the radial bearing 5*a*, which is a point of effort of the rolling direction force in the roll axis direction, is interposed between the points. In the example of FIG. 15, the side surface of the exit side of the upper work roll chock 5 is supported by the load detection devices 21*a* and 21*b* in a manner that the center C of the radial bearing 5*a* of the upper work roll chock 5 in the roll axis direction is interposed between the load detection devices 21*a* and 21*b*. In the same manner, even if the upper work roll chock 5 moves in the roll axis direction, a side surface of the entry side of the upper work roll chock 5 is also supported all the time at multiple points in the roll axis direction in a manner that the center C of the radial bearing 5*a*, which is a point of effort of the rolling direction force in the roll axis direction, is interposed between the points. In the example of FIG. 15, the side surface of the entry side of the upper work roll chock 5 is supported by the load detection devices 22*a* and 22*b* in a manner that the center C of the radial bearing 5*a* of the upper work roll chock 5 in the roll axis direction is interposed between the load detection devices 22*a* and 22*b*.

Accordingly, even if a rolling direction force is applied to the upper work roll chock 5 from the upper work roll 1, the upper work roll chock 5 does not rotate or tilt. As a result, the load detection devices 21*a*, 21*b*, 22*a*, and 22*b* can each accurately detect the rolling direction force applied to the upper work roll chock 5.

Note that the rolling apparatus according to the present embodiment is provided with two load detection devices in the roll axis direction on each of the exit and entry sides of each work roll chock in the rolling direction. However, the number of the load detection devices is not necessarily be two, and, on each of the exit and entry sides of each work roll chock in the rolling direction, there may be provided three or more load detection devices disposed in a manner that the three or more load detection devices are shifted from each other in the roll axis direction.

Further, the rolling apparatus according to the present embodiment can be combined with the rolling apparatuses according to the first to third embodiments. For example, in the case where the second embodiment is combined with the fifth embodiment, multiple load detection devices are disposed in multiple rows in the roll axis direction and multiple rows in the draft direction on each of the exit and entry sides of each work roll chock in the rolling direction.

6. Sixth Embodiment

Next, with reference to FIG. 16, a sixth embodiment of the present invention will be described. A construction of a rolling apparatus according to the present embodiment is basically the same as the construction of the rolling apparatus according to the fifth embodiment. However, while the rolling apparatus according to the fifth embodiment includes two load detection devices on each of the exit and entry sides of each work roll chock in the rolling direction, the rolling apparatus according to the present embodiment includes one load detection device and one dummy block (protruding part) in the same manner as the third embodiment.

As shown in FIG. 16, the rolling apparatus according to the present embodiment includes two load detection devices and two dummy blocks in each work roll chock. In FIG. 16, an upper work roll chock exit side load detection device 21*a* and an upper work roll chock exit side dummy block 51 are provided on the exit side of the upper work roll chock 5 in the rolling direction. In this case, one of the load detection device 21*a* and the dummy block 51 is disposed at one side with respect to the center C of the radial bearing 5*a* in the roll axis direction, and the other is disposed at the other side with respect to the center C of the radial bearing 5*a* in the roll axis direction. In FIG. 16, the load detection device 21 is disposed at an inner side with respect to the center C of the radial bearing 5*a* in the roll axis direction, and the dummy block 51 is interposed at an outer side with respect to the center C of the radial bearing 5*a* in the roll axis direction. That is, the load detection device 21*a* and the dummy block 51 are arranged in the roll axis direction. In the same manner, an upper work roll chock entry side load detection device 22*a* and an upper work roll chock entry side dummy block 52 are provided on the entry side of the upper work roll chock 5 in the rolling direction.

Further, as seen in FIG. 16, the load detection device 21*a* is slightly protruded from the side surface of the exit side of the upper work roll chock 5, and the dummy block 51 is also slightly protruded from the side surface of the exit side of the upper work roll chock 5, the amount of protrusion being the same as the amount of protrusion of the load detection device 21*a*. Further, the load detection device 22*a* is slightly protruded from the side surface of the entry side of the upper work roll chock 5, and the dummy block 52 is also slightly protruded from the side surface of the entry side of the upper work roll chock 5, the amount of protrusion being the same as the amount of protrusion of the load detection device 22*a*.

Taking the upper work roll chock 5 as an example, in the present embodiment, the upper work roll chock exit side load detection device 21*a* and the upper work roll chock entry side load detection device 22*a* in particular are disposed such that the position in the roll axis direction of the upper work roll chock exit side load detection device 21*a* and the position in the roll axis direction of the upper work roll chock entry side load detection device 22*a* are the same as each other. In the same manner, the upper work roll chock exit side dummy block 51 and the upper work roll chock entry side dummy block 52 are disposed such that the position in the roll axis direction of the upper work roll chock exit side dummy block 51 and the position in the roll axis direction of the upper work roll chock entry side dummy block 52 are the same as each other.

Further, in the present embodiment, in the same manner as the third embodiment for example, the upper work roll chock exit side load calculation device 31 connected to the upper work roll chock exit side load detection device 21*a* calculates a rolling direction force on the basis of a load detected by the load detection device 21*a*, an interval in the roll axis direction between the center C of the radial bearing 5*a* provided to the upper work roll chock 5 and the load detection device 21*a*, and an interval in the draft direction between the center C of the radial bearing 5*a* provided to the upper work roll chock 5 and the dummy block 51.

7. Modified Example

The rolling apparatuses according to the embodiments may also have the following constructions.

Modified Example 1

In the embodiments described above, the side surfaces of the upper work roll chock 5 face the housing 10 on which the project blocks 11 and 12 are not disposed, and the side surfaces of the lower work roll chock 6 face the project blocks 11 and 12. However, the main body of the rolling apparatus may not necessarily have such a construction. For example, as shown in FIG. 17, the side surfaces of both the work roll chocks 5 and 6 may have the construction in which the side surfaces of both the work roll chocks 5 and 6 face the project blocks 11 and 12.

In this case, for example, in the second embodiment described above, it is effective to arrange three or more load detection devices in the draft direction on each of the exit and entry sides of each work roll chock in the rolling direction.

FIG. 18 shows a rolling apparatus in which three load detection devices 21*a*, 21*b*, and 21*c* are disposed in the upper work roll chock 5 on the exit side of the upper work roll chock 5 in the rolling direction, and three load detection devices 22*a*, 22*b*, and 22*c* are disposed in the upper work roll chock 5 on the entry side of the upper work roll chock 5 in the rolling direction. The load detection devices 21*a*, 21*b*, and 21*c* on the exit side in the rolling direction are disposed in a manner that the load detection devices 21*a*, 21*b*, and 21*c* are arranged in the draft direction, and in the same manner, the load detection devices 22*a*, 22*b*, and 22*c* on the entry side in the rolling direction are disposed in a manner that the load detection devices 22*a*, 22*b*, and 22*c* are arranged in the draft direction.

In the thus constructed rolling apparatus, when the roll gap between the upper work roll 1 and the lower work roll 2 is small, all load detection devices face the project blocks 11 and 12. Accordingly, a rolling direction force is calculated on the basis of the loads detected by all those load detection devices. On the other hand, as shown in FIG. 18, when the roll gap increases, the load detection devices 21*a* and 22*a*, which are disposed uppermost, do not face the project blocks 11 and 12 anymore. However, even in this case, the load detection devices 21*b*, 21*c*, 22*b*, and 22*c* still face the project blocks 11 and 12. Consequently, the rolling direction force can be calculated on the basis of the load detected by the load detection devices facing the project blocks 11 and 12. That is, the thus constructed rolling apparatus can accurately measure the rolling direction force even if the roll gap increases.

Modified Example 2

Further, in the embodiments described above, one or more load detection devices are provided on each of the entry and exit sides of the upper and lower work roll chocks 5 and 6 in the rolling direction. However, one or more load detection devices may not be provided on each of all the entry and exit sides of the upper and lower work roll chocks 5 and 6 in the rolling direction. For example, one or more load detection devices may be provided only on the exit side of the upper work roll chock 5 in the rolling direction, or one or more load detection devices may be provided only on the exit side of the lower work roll chock 6 in the rolling direction. Alternatively, one or more load detection devices may be provided only on the entry side and the exit side of the upper work roll chock 5 in the rolling direction, or one or more load detection devices may be provided only on the entry side and the exit side of the lower work roll chock 6 in the rolling direction.

Modified Example 3

In addition, in the embodiments described above, the load detection devices are connected to the respective load calculation devices through wire. However, a detection signal of each load detection device may be transmitted via radio. In this case, each load detection device is connected to an antenna provided to each work roll chock, and the load calculation device is connected to a receiver. The detection signal of the load detection device is subjected to appropriate modulation processing and is input to the antenna. The detection signal is sent as a radio wave to the outside of the work roll chock from the antenna, and the radio wave is received by the receiver. As a result, the detection signal is transmitted to the load calculation device. Note that the type of radio communication may be any. Examples of the radio communication means include communication based on a near field communication standard, such as Bluetooth (registered trademark), and communication performed using a wireless LAN, infrared data communication, or the like.

In this way, the load detection device transmits the detection signal via radio, and thus, the detection signal of the load detection device can be transmitted easily at high speed on a real-time basis, with a simple and small construction. In addition, with such a construction, limitations related to device arrangement are reduced, such as position relationship between devices (load detection devices, bending devices, and the like) provided to the roll chocks and the project blocks. That is, the wiring for connecting each load detection device to a load calculation device is not necessary, and hence, wire routing that complicatedly passing around the wiring in order not to interfere the rolling apparatus-in-operation is not necessary. Those are extremely helpful for improving operation environment and reducing cost.

Modified Example 4

Further, as shown in FIG. 19, the second embodiment and the fifth embodiment may be provided with covers 25, 26, 27, and 28 each covering surfaces of two adjacent load detection devices. Note that parts for fixing the covers and waterproofing treatment for preventing water from entering into the inner side of the load detection device are not shown in FIG. 19. In this case, for example, the upper work roll chock 5 is supported by the cover 25 covering the load detection devices 21*a* and 21*b* and the cover 26 covering the load detection devices 22*a* and 22*b*. In the same manner, the lower work roll chock 6 is supported by the cover 27 covering the load detection devices 23*a* and 23*b* and the cover 28 covering the load detection devices 24*a* and 24*b*.

In this case, with increase in lengths L of the covers 25, 26, 27, and 28 in the draft direction, the areas being in contact with the side surfaces of the work roll chock 5 and the project block 12 increase, and sufficient contact lengths with the work roll chocks can be always maintained. For example, there may be a case where there is no sufficient space between two load detection devices in the draft direction depending on the shape and structure (including inner structure) of the housing and the project block. In this case, the same effect of the work roll chock-tilt prevention can be obtained by providing a cover having a length sufficient to cover the surfaces of two load detection devices.

Note that, as shown in FIG. 20, the covers 25, 26, 27, and 28 may also be provided to the load detection devices 21, 22, 23, and 24, respectively, as in the first embodiment. Also in this case, with increase in the lengths of the covers, the areas being in contact with the side surfaces of the roll chock 5 and the project block 12 increase. Accordingly, even in the case where the positions of the load detection devices 21, 22, 23, and 24 shift in the draft direction with respect to the position of the roll axis A1 of the work roll 1 or the position of the roll axis 2A of the work roll 2, the same effect of the work roll chock-tilt prevention can be obtained by providing the covers to the load detection devices.

Modified Example 5

With combination of the embodiments, there can be constructed a rolling apparatus which includes at least three load detection devices on at least one of the entry side in the rolling direction and the exit side of the rolling direction, and in which the at least three load detection devices are disposed in a manner that they shift in at least one of the draft direction and the roll axis direction of the work rolls. In this case, each load detection device is disposed so as to be shifted in one of the draft direction and the roll axis direction of the work rolls, in a manner that the point of effort of the rolling direction force of each of the work rolls is located within an area defined by connecting the load detection devices.

For example, as shown in FIG. 21, three load detection devices 22*a*, 22*b*, and 22*c* are disposed in a triangular shape, and thus, a movement in a tilting manner of the work roll chock 5 can be prevented and the rolling direction force can be detected with high accuracy. To be specific, two load detection devices 22*a* and 22*c* are disposed above the roll axis A1 of the work roll 1 in the draft direction, and the load detection device 22*b* is disposed below the roll axis A1 of the work roll 1 in the draft direction. Further, two load detection devices 22*a* and 22*c* disposed above the roll axis A1 are disposed in a manner that the center C of a radial bearing 5*a*, which is a point of effort of the rolling direction force in the roll axis direction, is interposed between the load detection devices 22*a* and 22*c*.

When the load detection devices 22*a*, 22*b*, and 22*c* are arranged in this manner, the point of effort of the rolling direction force is located within an area S having a triangular shape defined by connecting the three load detection devices 22*a*, 22*b*, and 22*c*. Accordingly, even if the work roll 1 moves in the draft direction or in the roll axis direction, at least two load detection devices are always supporting the work roll chock 5 in the state of interposing therebetween the point of effort of the rolling direction force, and thus, the tilt of the work roll chock 5 can be prevented.

Note that the area in which the point of effort of the rolling direction force is to be located is not limited to the area having a triangular shape formed by disposing three load detection devices 22*a*, 22*b*, and 22*c*. For example, as shown in FIG. 22, the area may be an area S having a quadrilateral shape formed by four load detection devices 22*a*, 22*b*, 22*c*, and 22*d*, in which the roll axis is interposed between two load detection devices in the draft direction and the center of the radial bearing is interposed between two load detection devices in the roll axis direction. In this way, the shape may be a trapezium, a rhombus, or other polygons, that can be formed by disposing multiple load detection devices.

8. Method of Controlling Rolling Apparatus

Next, there will be described a method of controlling a rolling apparatus on the basis of the thus detected rolling direction force.

In the example shown in FIG. 6, the upper work roll chock exit side load detection device 21 and the upper work roll chock entry side load detection device 22 are connected to an upper work roll chock rolling direction force calculation device 41. The upper work roll chock rolling direction force calculation device 41 calculates a difference between a load detected by the upper work roll chock exit side load detection device 21 and a load detected by the upper work roll chock entry side load detection device 22, and, on the basis of the calculation result, calculates the rolling direction force acting on the upper work roll chock 5.

On the other hand, in the example shown in FIG. 10, the upper work roll chock exit side load calculation device 31 and the upper work roll chock entry side load calculation device 32 are connected to an upper work roll chock rolling direction force calculation device 41. The upper work roll chock rolling direction force calculation device 41 calculates a difference between a calculation result obtained by the upper work roll chock exit side load calculation device 31 and a calculation result obtained by the upper work roll chock entry side load calculation device 32, and, on the basis of the calculation result, calculates the rolling direction force acting on the upper work roll chock 5.

In the same manner, in the example shown in FIG. 6, the lower work roll chock exit side load detection device 23 and the lower work roll chock entry side load detection device 24 are connected to a lower work roll chock rolling direction force calculation device 42. The lower work roll chock rolling direction force calculation device 42 calculates a difference between a load detected by the lower work roll chock exit side load detection device 23 and a load detected by the lower work roll chock entry side load detection device 24, and, on the basis of the calculation result, calculates the rolling direction force acting on the lower work roll chock 6.

On the other hand, in the example shown in FIG. 10, the lower work roll chock exit side load calculation device 33 and the lower work roll chock entry side load calculation device 34 are connected to a lower work roll chock rolling direction force calculation device 42. The lower work roll chock rolling direction force calculation device 42 calculates a difference between a calculation result obtained by the lower work roll chock exit side load calculation device 33 and a calculation result obtained by the lower work roll chock entry side load calculation device 34, and, on the basis of the calculation result, calculates the rolling direction force acting on the lower work roll chock 6.

As shown in FIG. 6 and FIG. 10, the upper work roll chock rolling direction force calculation device 41 and the lower work roll chock rolling direction force calculation device 42 are connected to an operator side work roll chock rolling direction force calculation device 43.

In the case of controlling a zigzag movement and a camber, the operator side work roll chock rolling direction force calculation device 43 calculates the sum of the calculation result of the upper work roll chock rolling direction force calculation device 41 and the calculation result of the lower work roll chock rolling direction force calculation device 42, to calculate the rolling direction resultant force acting on the upper work roll 1 and the lower work roll 2 on the operator side. The calculation processing described above is conducted not only for the operator side but also for the driving side by using entirely the same device construction (not shown), and the rolling direction resultant force acting on the upper work roll 1 and the lower work roll 2 on the driving side is calculated by a driving side work roll chock rolling direction force calculation device 44.

After that, an operator side/driving side rolling direction force calculation device 45 calculates the difference between the calculation results on the operator side and the calculation results on the driving side, and in this way, the difference of the rolling direction forces acting on the upper and lower work roll chocks between the operator side and the driving side is calculated.

Next, a control quantity calculation device 46 sets the difference of the rolling direction forces acting on the work roll chocks 5 and 6 between the operator side and the driving side to a suitable target value and calculates a left-right swivelling component control quantity of the roll gap of the rolling mill on the basis of the calculation result of the difference of the rolling direction forces between the operator side and the driving side for preventing the camber. Here, the control quantity is calculated by PID calculation that takes a proportional (P) gain, an integration (I) gain, and a differential (D) gain into consideration, for example, on the basis of the left-right difference of the rolling direction force. A control device 47 controls the left-right swivelling component of the roll gap of the rolling mill on the basis of this control quantity calculation result. In this way, rolling free from the occurrence of camber or having extremely slight camber can be accomplished.

Note that, in the calculation processing described above, only addition and subtraction are basically done on the outputs of load detection devices before the calculation result of the operator side/driving side rolling direction force calculation device 45 is obtained. Therefore, the sequence of calculation processing described above may be arbitrarily changed. For example, it is possible to first add the outputs of the upper and lower exit side load detection devices, then to calculate the difference from the addition result on the entry side and to finally calculate the difference between the operator side and the driving side. Alternatively, it is possible to first calculate the difference between the operator side and the driving side of the outputs of the load detection devices at the respective positions, then to calculate the sum of the upper and lower detection devices and to finally calculate the difference between the entry side and the exit side.

In the case of controlling a warp, the operator side work roll chock rolling direction force calculation device 43 calculates the difference between the calculation result of the upper work roll chock rolling direction force calculation device 41 and the calculation result of the lower work roll chock rolling direction force calculation device 42, to calculate the difference of the rolling direction forces acting on the work roll chocks on the operator side between the upper side and the lower side. The calculation processing described above is conducted not only for the operator side but also for the driving side by using entirely the same device construction (not shown), and the difference of the rolling direction forces acting on the work roll chocks on the driving side between the upper side and the lower side is calculated by the driving side work roll chock rolling direction force calculation device 44. The operator side/driving side rolling direction force calculation device 45 totalizer the calculation results on the operator side and the calculation results of the driving side (difference between the upper side and the lower side), and in this way, the difference of the rolling direction forces acting on the work roll chocks between the upper side and the lower side is calculated.

Next, the control quantity calculation device 46 sets the difference of the rolling direction forces acting on the work roll chocks between the upper side and the lower side to a suitable target value and calculates an upper side-lower side swivelling component control quantity of a roll speed of the rolling mill on the basis of the calculation result of the difference of the rolling direction forces between the upper side and the lower side for preventing the warp. Here, the control quantity is calculated by PID calculation that takes a proportional (P) gain, an integration (I) gain, and a differential (D) gain into consideration, for example, on the basis of the upper side-lower side rolling direction force.

Then, the control device 47 controls the upper side-lower side swivelling component control quantity of the roll speed of the upper drive electric motor 35 and the lower drive electric motor 36 of the rolling mill on the basis of this control quantity calculation result. In this way, rolling free from the occurrence of warp or having extremely slight warp can be accomplished.

Note that, although the roll speed of the rolling mill is used here as the upper side-lower side swivelling component control quantity, a frictional coefficient between a rolling roll and a material to be rolled, a difference in temperature of a material to be rolled between the upper surface and the lower surface, an angle of incidence of a material to be rolled, a position of the work roll chock in the horizontal direction, top and bottom rolling torques, or the like may be also used.

In the case of zero point adjustment, after going through the same processes as the calculation processes of the zigzag movement and camber control described above, the operator side/driving side rolling direction force calculation device 45 calculates the difference between the calculation results on the operator side and the calculation results on the driving side, and in this way, calculates the difference of the rolling direction forces acting on the work roll chocks between the operator side and the driving side.

Then, the hydraulic screw down devices 9 are operated simultaneously on the operator side and on the driving side and are tightened until the sum of right and left counterforces of a backup roll is equal to a preset value (zero point adjustment load), and, under that state, leveling operation for rendering the difference of the rolling direction forces between the operator side and the driving side zero is executed.

Subsequently, the control quantity calculation device 46 calculates the control quantity of the hydraulic screw down device 9 such that the difference of the rolling direction forces acting on the work roll chocks 5 and 6 between the operator side and the driving side become zero and that the zero point adjustment load is maintained, on the basis of the results of the difference of the rolling direction forces between the operator side and the driving side (difference between the operator side and the driving side) calculated by the operator side/driving side rolling direction force calculation device 45. Then, the control device 47 controls the reduction position of a roll of the rolling mill on the basis of the control quantity calculation result. In this way, the difference of the rolling direction forces acting on the work roll chocks between the operator side and the driving side is set to zero, and the reduction position at that point is set as the zero point of the reduction position of the operator side and the driving side individually.

Note that, as described above, the difference of the rolling direction forces acting on the work roll chocks (upper work roll chock 5 and lower work roll chock 6) between the operator side and the driving side is not influenced by a roll thrust force. Therefore, even if a thrust force occurs between the rolls, the zero point setting of the reduction leveling can be accomplished with extremely high accuracy.

Heretofore, preferred embodiments of the present invention have been described in detail with reference to the appended drawings, but the present invention is not limited thereto. It should be understood by those skilled in the art that various changes and alterations may be made without departing from the spirit and scope of the appended claims.

Note that, in the embodiments described above, there has been used a four high rolling mill having only the work rolls and the backup rolls for the description, but the present invention is not limited thereto. The technology according to the present invention can be also applied to a six high rolling mill which has intermediate rolls, for example.

REFERENCE SIGNS LIST

1 upper work roll
2 lower work roll
3 upper backup roll
4 lower backup roll
5 upper work roll chock (operator side)
6 lower work roll chock (operator side)
7 upper backup roll chock (operator side)
8 lower backup roll chock (operator side)
9 screw down device
10 housing
11 exit side project block (operator side)
12 entry side project block (operator side)
21 upper work roll chock exit side load detection device (operator side)
21*a* first load detection device on exit side of upper work roll chock
21*b* second load detection device on exit side of upper work roll chock
22 upper work roll chock entry side load detection device (operator side)
22*a* first load detection device on entry side of upper work roll chock
22*b* second load detection device on entry side of upper work roll chock
23 lower work roll chock exit side load detection device (operator side)
23*a* first load detection device on exit side of lower work roll chock
23*b* second load detection device on exit side of lower work roll chock
24 lower work roll chock entry side load detection device (operator side)
24*a* first load detection device on entry side of lower work roll chock
24*b* second load detection device on entry side of lower work roll chock
31 upper work roll chock exit side load calculation device (operator side)
32 upper work roll chock entry side load calculation device (operator side)
33 lower work roll chock exit side load calculation device (operator side)
34 lower work roll chock entry side load calculation device (operator side)
35 upper drive electric motor
36 lower drive electric motor
41 upper work roll chock rolling direction force calculation device (operator side)
42 lower work roll chock rolling direction force calculation device (operator side)
43 operator side work roll chock rolling direction force calculation device
44 driving side work roll chock rolling direction force calculation device
45 operator side/driving side rolling direction force calculation device
46 control quantity calculation device
47 control device
51 upper work roll chock exit side dummy block
52 upper work roll chock entry side dummy block
53 lower work roll chock exit side dummy block
54 lower work roll chock entry side dummy block
121 upper work roll chock exit side load detection device
122 upper work roll chock entry side load detection device
123 lower work roll chock exit side load detection device
124 lower work roll chock entry side load detection device
141 upper work roll rolling direction force calculation device
142 lower work roll rolling direction force calculation device

The invention claimed is:

1. A rolling apparatus for a flat-rolled metal material, the rolling apparatus having at least a pair of upper and lower work rolls and a pair of upper and lower backup rolls, the rolling apparatus comprising:

a pair of work roll chocks configured to hold the respective work rolls;

housings or project blocks configured to hold the work roll chocks; and one or more load detection devices provided in one of the work roll chocks in a manner that the one or more load detection devices face one of the housings or one of the project blocks, the load detection devices each detecting a load acting on one of the work roll chocks on at least one of an entry side in a rolling direction and an exit side in the rolling direction, wherein each of the work roll chocks has at least one of the load detection devices on each surface facing the housing or the project block in the rolling direction, the load detection devices are disposed in a manner that a roll axis of a corresponding one of the work rolls is located within a range in which the load detection devices are each in contact with the housing or the project block in a draft direction when one load detection device is disposed on each surface of the pair of work roll chocks facing the housing or the project block in the rolling direction, the load detection devices are disposed in a manner that the roll axis of the corresponding one of the work rolls is located within a range between two load detection devices or a range defined by connecting at least three of load detection devices, the range including the surface that is in contact with the housing or the project block in the draft direction, when the plurality of load detection devices are disposed on each surface of the pair of work roll chocks facing the housing or the project block in the rolling direction, a rotation moment generated on each of the work roll chocks caused by the rolling direction force is equal to a counter rotation moment generated by counterforce against the rotation moment by disposing the load detection devices.

2. The rolling apparatus according to claim 1, wherein the plurality of load detection devices are disposed on each surface of the pair of work roll chocks, at least one of a plurality of the load detection devices is disposed at a position higher than a position of a roll axis of one of the work rolls held by a corresponding one of the work roll chocks, the load detection devices being arranged in a manner that the load detection devices are shifted from each other in the draft direction of the work roll, and wherein at least one of the plurality of the load detection devices is disposed at a position lower than the position of the roll axis of the one of the work rolls held by the corresponding one of the work roll chocks, the load detection devices being arranged in a manner that the load detection devices are shifted from each other in the draft direction of the work roll.

3. The rolling apparatus according to claim 1, further comprising:

a load calculation device configured to calculate a rolling direction force by adding up loads detected by a plurality of the load detection devices provided on the entry side in the rolling direction or the exit side in the rolling direction.

4. The rolling apparatus according to claim 1, wherein the plurality of load detection devices are disposed on each surface of the pair of work roll chocks, one or more load detection devices other than at least one of the load detection devices out of the plurality of load detection devices are replaced with respective protruding parts, and wherein the at least one of the load detection devices and the protruding parts are disposed in a manner that the at least one of the load detection devices and the protruding parts are shifted in the draft direction so as to be protruded from one of side surfaces that face one of the housings or one of the project blocks of one of the work roll chocks.

5. The rolling apparatus according to claim 4, wherein a load detection device disposed on the entry side in the rolling direction and a load detection device disposed on the exit side in the rolling direction are located at an identical height with each other in the draft direction, and wherein a protruding part disposed on the entry side in the rolling direction and a protruding part disposed on the exit side in the rolling direction, the protruding parts being disposed in a corresponding manner to the respective load detection devices, are located at an identical height with each other in the draft direction.

6. The rolling apparatus according to claim 4, further comprising:

a load calculation device configured to calculate a rolling direction force on a basis of a load detected by each of the load detection devices, an interval in the draft direction between an axis of a corresponding one of the work rolls held by a corresponding one of the work roll chocks and the load detection device, and an interval in the draft direction between the axis of the work roll and a corresponding one of the protruding parts.

7. A rolling apparatus for a flat-rolled metal material, the rolling apparatus having at least a pair of upper and lower work rolls and a pair of upper and lower backup rolls, the rolling apparatus comprising:

a pair of work roll chocks configured to hold the respective work rolls;

housings or project blocks configured to hold the work roll chocks; and one or more load detection devices provided in one of the work roll chocks in a manner that the one or more load detection devices face one of the housings or one of the project blocks, the load detection devices each detecting a load acting on one of the work roll chocks on at least one of an entry side in a rolling direction and an exit side in the rolling direction, wherein each of the work roll chocks has at least one of the load detection devices on each surface facing the housing or the project block in the rolling direction, the load detection devices are disposed in a manner that a center of a radial bearing provided to one of the work roll chocks is located within a range in which the load detection devices are each in contact with the housing or the project block in a roll axis direction, when one load detection device is disposed on each surface of the pair of work roll chocks, the load detection devices are disposed in a manner that the center of the radial bearing provided to one of the work roll chocks is located within a range between the two load detection devices or a range defined by connecting at least three of load detection devices, the range including the surface that in contact with the housing or the project block in the roll axis direction, when the plurality of load detection devices are disposed on each surface of the pair of work roll chocks, a rotation moment generated on each of the work roll chocks caused by the rolling direction force is equal to a counter rotation moment generated by counterforce against the rotation moment by disposing the load detection devices.

8. The rolling apparatus according to claim 7, wherein the plurality of load detection devices are disposed on each surface of the pair of work roll chocks, one or more load detection devices other than at least one of the load detection devices out of the plurality of load detection devices are replaced with respective protruding parts, and wherein the at least one of the load detection devices and the protruding parts are disposed in a manner that the at least one of the load detection devices and the protruding parts are shifted in the roll axis direction so as to be protruded from one of side surfaces that face one of the housings or one of the project blocks of one of the work roll chocks.

9. The rolling apparatus according to claim 8, wherein the plurality of load detection devices are disposed on each surface of the pair of work roll chocks, a load detection device disposed on the entry side in the rolling direction and a load detection device disposed on the exit side in the rolling direction are located at an identical position with each other in the roll axis direction, and wherein a protruding part disposed on the entry side in the rolling direction and a protruding part disposed on the exit side in the rolling direction, the protruding parts being disposed in a corresponding manner to the respective load detection devices, are located at an identical position with each other in the roll axis direction.

10. The rolling apparatus according to claim 8, further comprising:

a load calculation device configured to calculate a rolling direction force on a basis of a load detected by each of the load detection devices, an interval in the roll axis direction between a center of a radial bearing provided to a corresponding one of the work roll chocks and the load detection device, and an interval in the roll axis direction between the center of the radial bearing and a corresponding one of the protruding parts.

11. The rolling apparatus according to claim 1, wherein the load detection devices each transmit a detection signal via radio to a load calculation device.

12. The rolling apparatus according to claim 1, further comprising:

a cover configured to cover the load detection devices, the cover being provided between one of the housings or one of the project blocks and the load detection devices, wherein the cover is provided in a manner that the point of effort of the rolling direction force is located within a range in which one of the housings or one of the project blocks faces the cover.

13. The rolling apparatus according to claim 3, wherein the load detection devices each transmit a detection signal via radio to a load calculation device.

* * * * *